US011712069B2

(12) United States Patent
Jebb

(10) Patent No.: US 11,712,069 B2
(45) Date of Patent: Aug. 1, 2023

(54) FASHION ACCESSORY ANCHOR

(71) Applicant: Gabriel Jebb, Leucadia, CA (US)

(72) Inventor: Gabriel Jebb, Leucadia, CA (US)

( * ) Notice: Subject to any disclaimer, the term of this patent is extended or adjusted under 35 U.S.C. 154(b) by 60 days.

(21) Appl. No.: 17/359,516

(22) Filed: Jun. 26, 2021

(65) Prior Publication Data

US 2021/0321680 A1 Oct. 21, 2021

Related U.S. Application Data

(63) Continuation of application No. 16/534,048, filed on Aug. 7, 2019, now Pat. No. 11,071,331.

(60) Provisional application No. 62/715,100, filed on Aug. 6, 2018.

(51) Int. Cl.
*A41D 1/18* (2006.01)
*A41D 1/22* (2018.01)

(52) U.S. Cl.
CPC ..... *A41D 1/18* (2013.01); *A41D 1/22* (2013.01); *A41D 2400/38* (2013.01)

(58) Field of Classification Search
CPC ..... A41D 1/18; A41D 1/02; A41D 2400/38
See application file for complete search history.

(56) References Cited

U.S. PATENT DOCUMENTS 4,769,875 A * 9/1988 Hartman ..... B60P 7/0823 428/68
6,473,944 B1 * 11/2002 Vazin ..... F16G 11/14 24/712.9
6,698,030 B2 * 3/2004 Cutler ..... A41F 15/007 450/86
7,410,407 B2 * 8/2008 Krammel ..... A41F 15/02 450/86
7,601,048 B2 * 10/2009 Groner ..... A41F 15/02 224/198
7,677,525 B2 * 3/2010 Sanchez ..... A01G 9/128 24/30.5 S
7,959,489 B2 * 6/2011 Shaffstall ..... A41F 15/02 450/86
8,631,515 B2 * 1/2014 Van Sisseren ..... A41F 15/002 450/86
8,904,569 B2 * 12/2014 Dumouchelle ..... A41F 15/007 224/264
9,254,019 B2 * 2/2016 Sloan ..... G09B 19/0076
2006/0264152 A1 * 11/2006 Krammel ..... A41F 15/02 450/86
2007/0101554 A1 * 5/2007 O'Brien ..... A42C 5/00 24/129 R (Continued)

OTHER PUBLICATIONS https://myhalto.com/ 7-Feb-2018 Jillyrox Limited 112 Alexandra Road, Illogan, Redruth, England, TR16 4EN.

*Primary Examiner* — Gloria M Hale
(74) *Attorney, Agent, or Firm* — NextWave IP Legal Services, LLC; Leon Fortin, Jr.

(57) ABSTRACT

A fashion accessory anchor device includes a pair of garment strap receiving holes disposed laterally on the device and an engagement surface in communication with the pair of receiving holes, the engagement surface for disposing the device on a nape of a user and through which a pair of garment straps are received. The anchor device further includes a fashion accessory retention region oriented relative to the pair of receiving holes to support a fashion accessory hanging therefrom.

20 Claims, 33 Drawing Sheets

(56) References Cited

U.S. PATENT DOCUMENTS

| | | | | |
|---|---|---|---|---|
| 2009/0235424 | A1* | 9/2009 | Carey | A41D 7/00 2/67 |
| 2010/0058516 | A1* | 3/2010 | Merriam-Smith | A41F 15/02 2/336 |
| 2012/0094576 | A1* | 4/2012 | Tedder | A41F 15/002 450/86 |
| 2016/0360813 | A1* | 12/2016 | Baase, II | A41D 27/08 |

* cited by examiner

FASHION ACCESSORY ANCHOR

CLAIM TO PRIORITY

This application is a continuation of U.S. application Ser. No. 16/534,048, filed Aug. 7, 2019 titled NECK STRAP FORCE DISTRIBUTION. Application Ser. No. 16/534,048 claims the benefit of U.S. provisional patent application No. 62/715,100, filed Aug. 6, 2018, titled HALTER SLIDER, the entirety of which is incorporated herein by reference.

BACKGROUND

1. Field

The methods and systems of neck strap force distribution described herein generally relate to accessories for apparel.

2. Description of Related Art

Wearers of swimwear, active wear, evening wear, other tie-behind the neck clothing and support devices must tie a knot behind their neck to support the clothing or device. For halter-top type clothing, the knot further supports the wearer's breasts in an attractive disposition. A tie-behind the neck article of clothing and the like puts pressure on a small area of the wearer's neck, which can result in migraine headaches, muscle pains, damage to vertebra, and the like along with general discomfort.

Additionally, there is no existing way for a person to hang jewelry from the back of their neck without the jewelry acting like a choker on the front of the wearer's neck. In an example, a woman may choose to turn a necklace backwards, but the weight of the necklace will essentially act as a choker which can also cause discomfort and skin irritation where it contacts the neck.

There remains a need, such as in the swim wear, active wear, fashion accessory industry, and many others that rely on a tie-behind the neck function for a way to safely secure the straps while distributing forces of the straps tied behind the neck.

SUMMARY

A tie-behind the neck strap support may provide benefits to a user including, health benefits, fashion benefits, ease of use benefits, additional fashion accessory benefits and the like. In embodiments, a tie-behind the neck strap support and force distribution device may address several limitations in the current art, including without limitation: a tied knot puts pressure on the back of a wearer's neck, which causes discomfort and headaches; women with larger busts cannot wear halters comfortably because it can cause marks and disfigurement; tied knot can slip and loosen, which makes the item secured by the know uncomfortable and does not provide adequate support for the bust; loosened knots can expose a wearer's body, such as woman's breasts when she comes out of the water wearing a halter top bathing suit; when tied knots get wet, they are hard to untie, retie, and are even more uncomfortable; loosely tied behind-the neck straps may allow the object being supported (e.g., a woman's breasts) to move uncomfortably, which might cause chaffing; tie-behind the neck items, such as halter top knots slip during activities, like dancing, working out, jogging, kayaking, and the like; also, there is no way for a wearer to display jewelry, trinkets, charms, identification, safety plates, and the like over the back of the wearer.

In embodiments, a neck strap force distribution device may alleviate the problems associated with tying a knot behind a wearer's neck. A neck strap force distribution device may be made out of a comfortable material and may conform to the shape of the back of the neck. In embodiments, such a neck strap force distribution device facilitates dissipating pressure required to support the item across a greater surface area in a comfortable manner.

The neck strap force distribution device facilitates creating friction between two neck straps (e.g., halter strings, and the like); this friction facilitates locking the device and the straps in place. In embodiments, the device doesn't allow the straps/strings to unintentionally loosen or become tighter regardless of activity level of the wearer.

In embodiments, a neck strap force distribution device may comprise a unique shape or design that offers a unique opportunity to create a "cute" shaped tan line (e.g., a heart shaped device may protect the portion of the back/neck behind the device to not be exposed to sun). The neck strap force distribution device also provides a mechanism that allows jewelry, charms, and fashion accessories to be safely attached to it. This provides wearers a means for having an option to "bling" out the nape of their neck.

A neck strap force distribution device dissipates the pressure point caused by a tied halter or other garment string knot at the back of the next of a user. The neck strap force distribution device achieves this by spreading the pressure over a greater surface area. The neck strap force distribution device also uses friction from the straps/halter strings to remain stable on the wearer's neck or upper back. In embodiments, the friction generated between the device and the straps may bypass the need to tie a knot. In embodiments, it also provides a larger surface area to support a knot if one is used. In embodiments, another benefit of the device is to allow a wearer to hang jewelry, charms, fashion accessories, bling, or other items mentioned herein over the wearer's neck, nape, upper back and the like. The device may provide a stable platform to attach accessories which can sit close to the nape of the neck.

The neck strap force distribution device will effectively solve the issues described herein. It dissipates the force/weight for which the neck strap is required across a substantially greater surface area than a tied knot, while using friction from the straps to lock the itself in place. Wearer's will be more comfortable for longer periods. In embodiments, the friction of tie behind the neck straps/strings and the placement of strap pass-through holes in the body of the device, will allow the device to be controllably adjusted in position (e.g., be slid up and down), but lock into place providing additional support to the. A knot can still be tied on top of the device if extreme support is desired or needed, yet the benefit of spreading the force across a larger surface area is still a primary feature of the device.

In embodiments, the device may curve responsively in use to anatomically fit the shape of the wearer. This use of the device provides more protection for the spinal cord and vertebra. The device provides additional protection in an area of greatest stress while providing a higher level of comfort. The reduction in direct pressure on the spine will allow a wearer to be more active.

In embodiments, the neck strap force distribution device may be made from comfortable materials like rubber, neoprene, silicone, vinyl, or any other material that can be produced to take the shape of a wearer's neck while still providing friction for the straps. Composite materials may also be used, like metal with a rubber backing or wood with a silicone lining, and the like. These and any other suitable composition or combination of materials is contemplated by the inventor and included herein.

In embodiments, the friction between the device and the straps allows for quicker adjustments, such as tightening or loosening of the straps without requiring untying and retying a knot; it further allows a wearer to fine tune the adjustments, and becomes a stable platform for mounting jewelry, dangling charms, fashion accessories, etc.

These and other systems, methods, objects, features, and advantages of the present disclosure will be apparent to those skilled in the art from the following detailed description of the preferred embodiment and the drawings.

All documents mentioned herein are hereby incorporated in their entirety by reference. References to items in the singular should be understood to include items in the plural, and vice versa, unless explicitly stated otherwise or clear from the text. Grammatical conjunctions are intended to express all disjunctive and conjunctive combinations of conjoined clauses, sentences, words, and the like, unless otherwise stated or clear from the context.

BRIEF DESCRIPTION OF THE FIGURES

The disclosure and the following detailed description of certain embodiments thereof may be understood by reference to the following figures.

DETAILED DESCRIPTION

Figure 1:
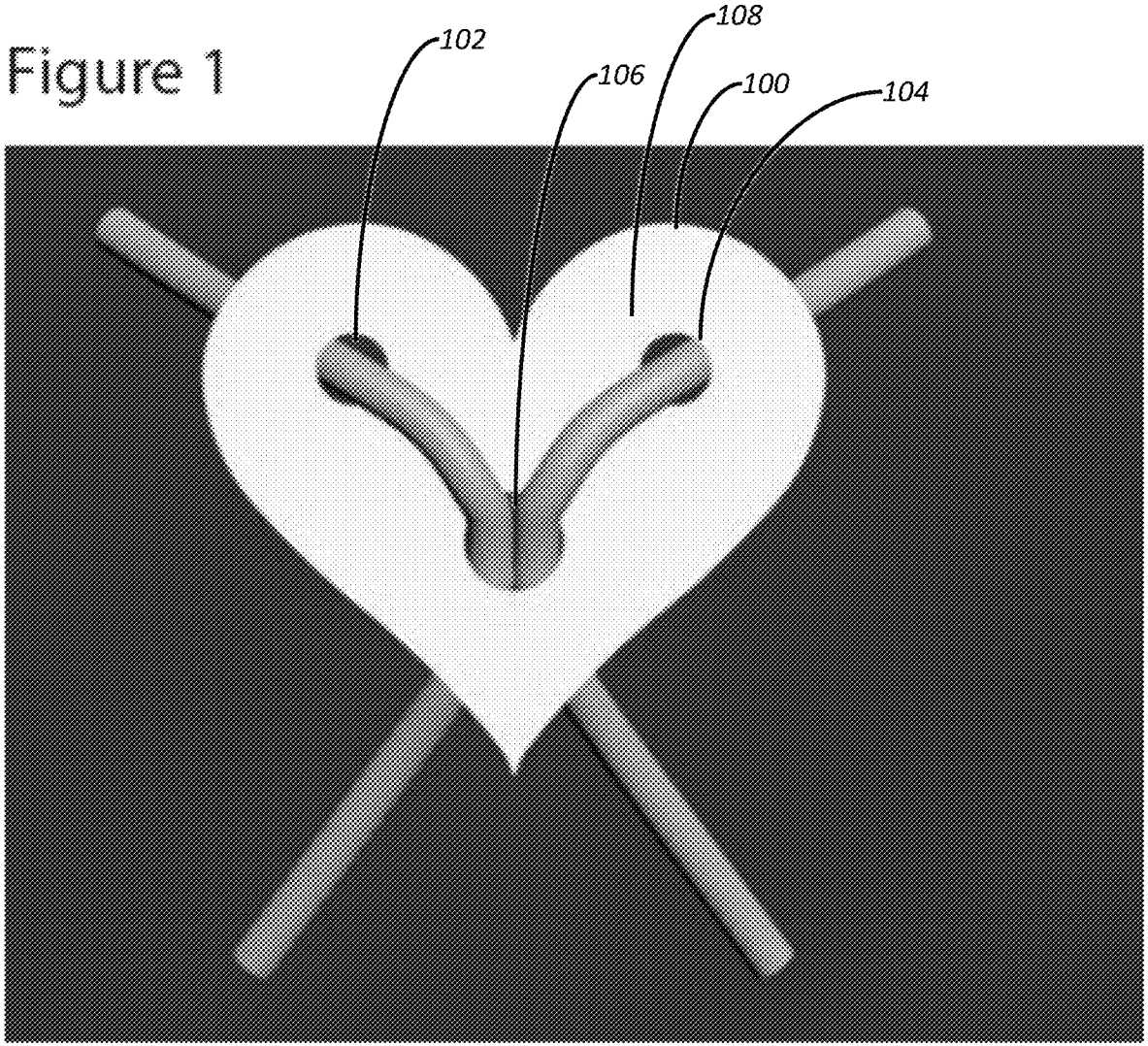
FIGS. 1-6 depict plan views of an embodiment of the neck strap force distribution device.
Figure 2:
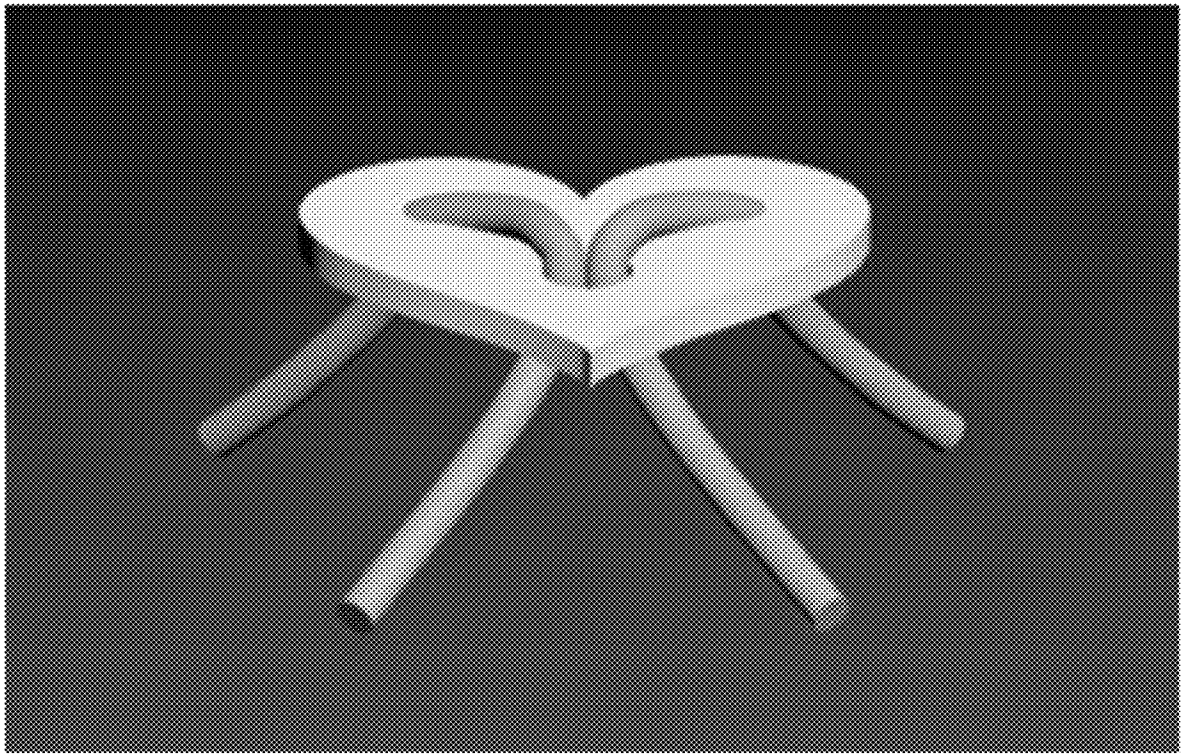
Figure 3:
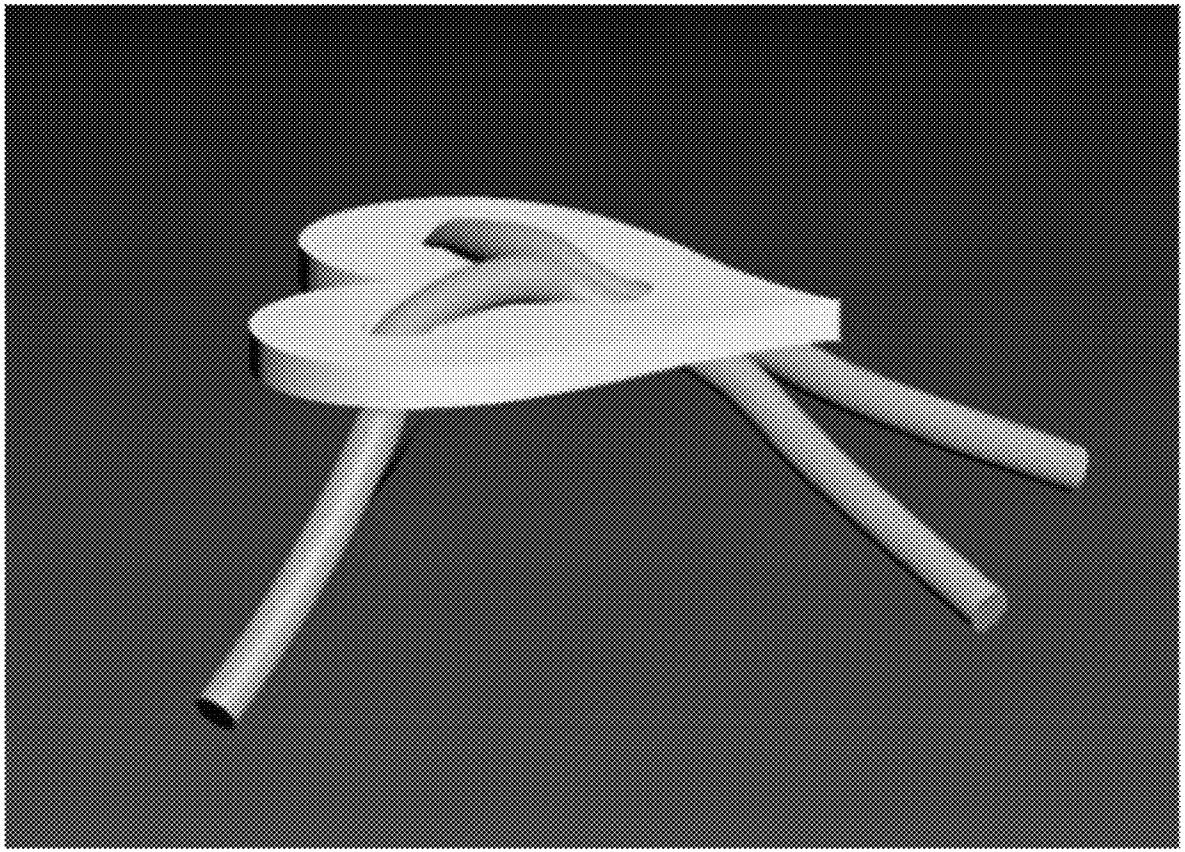
Figure 4:
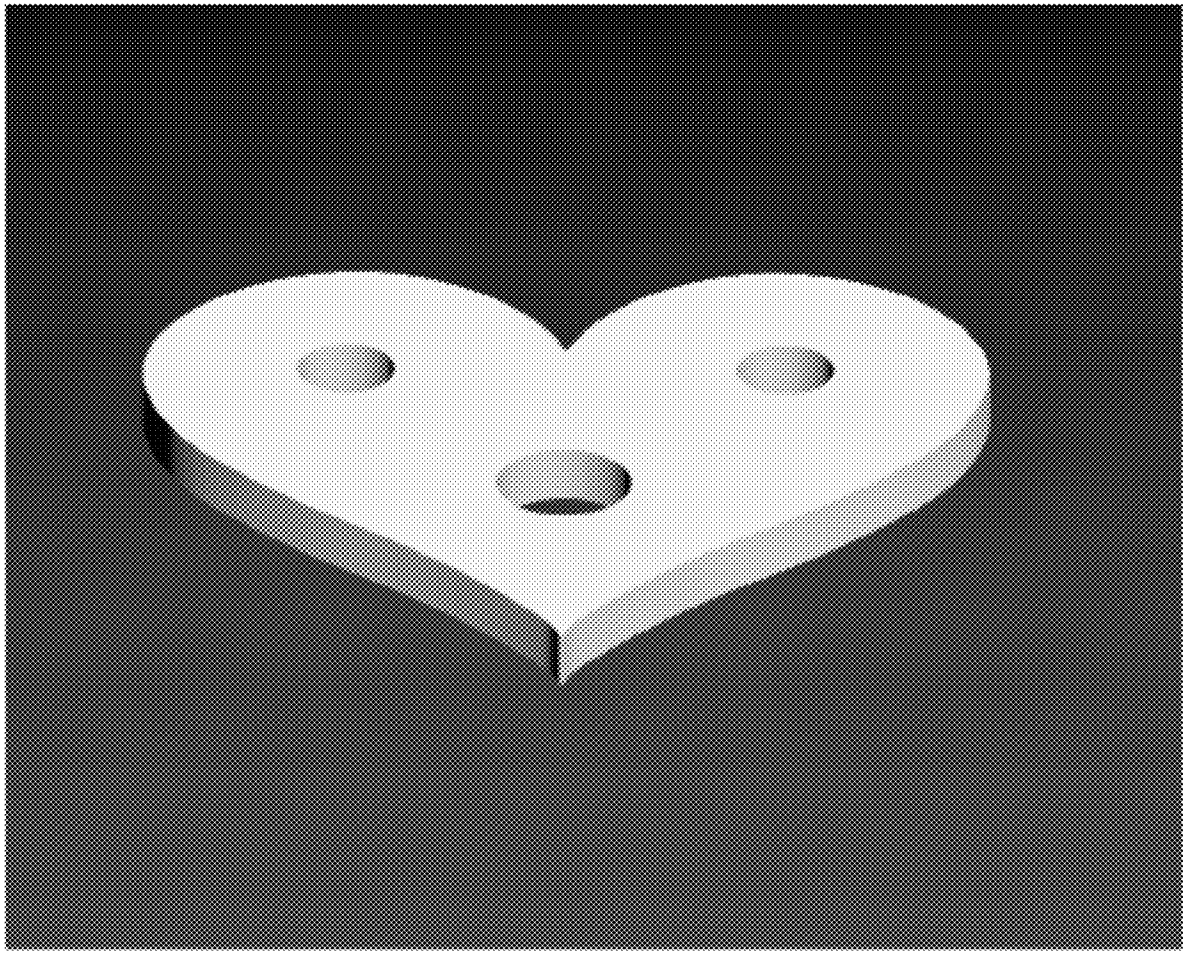
Figure 5:
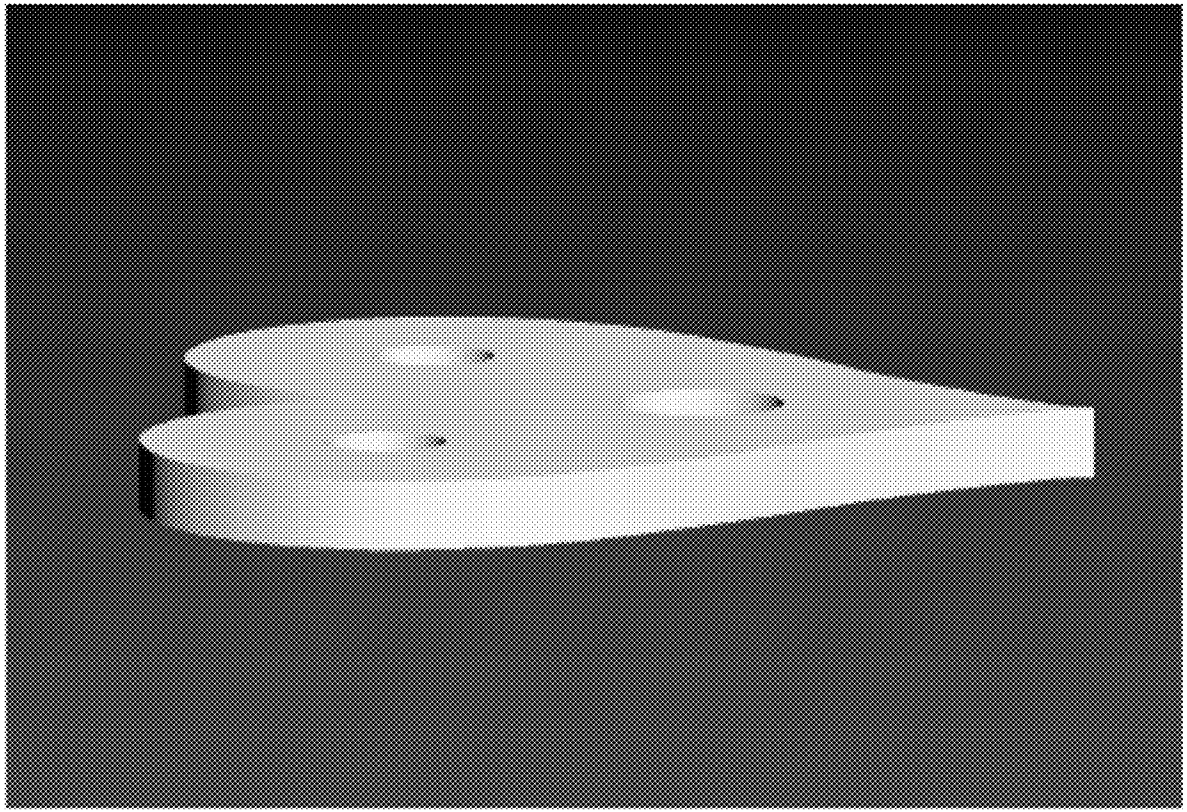
Figure 6:
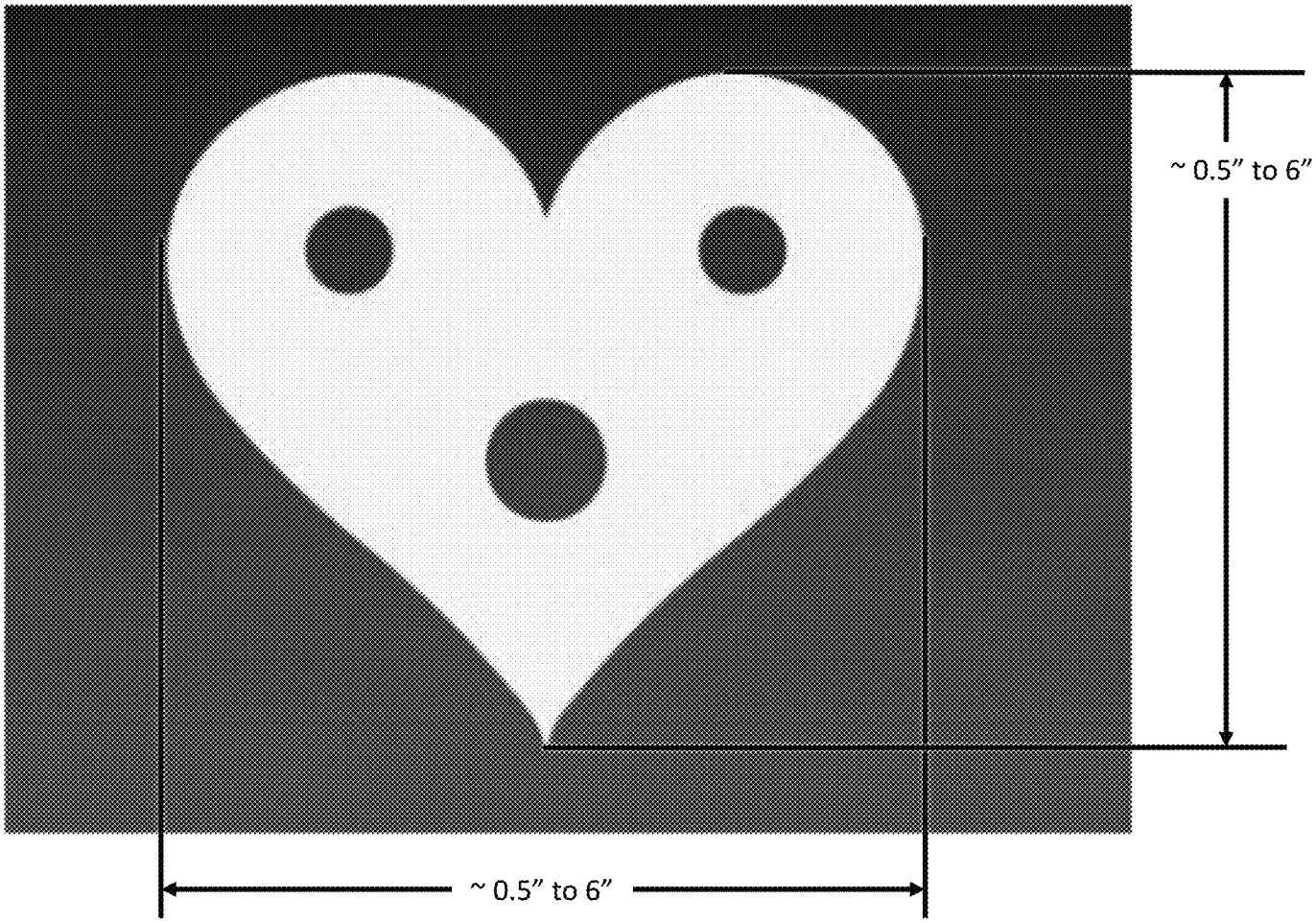
Figure 7:
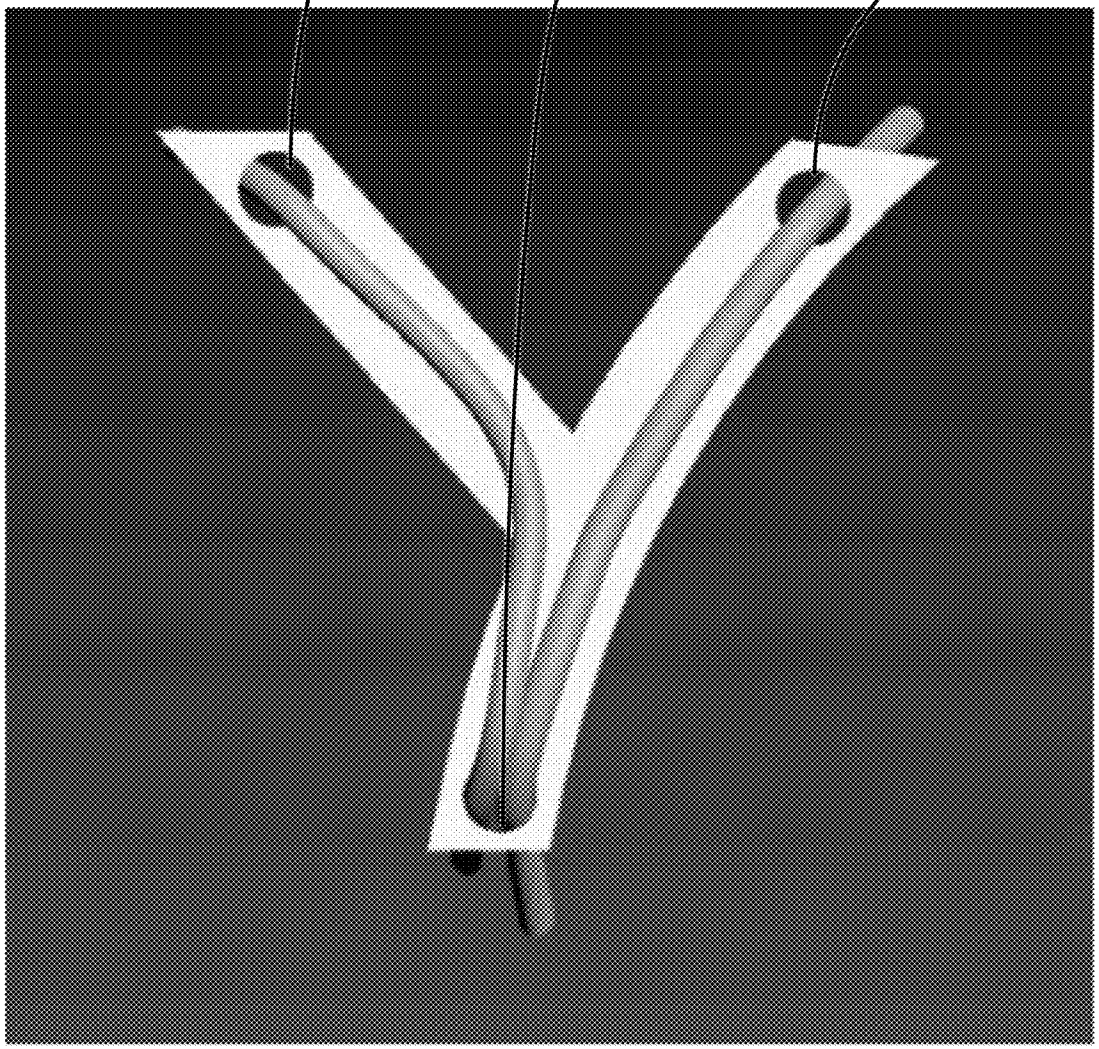
FIGS. 7-12 depict an alternate embodiment of the neck strap force distribution device in the shape of the letter "Y".
Figure 8:
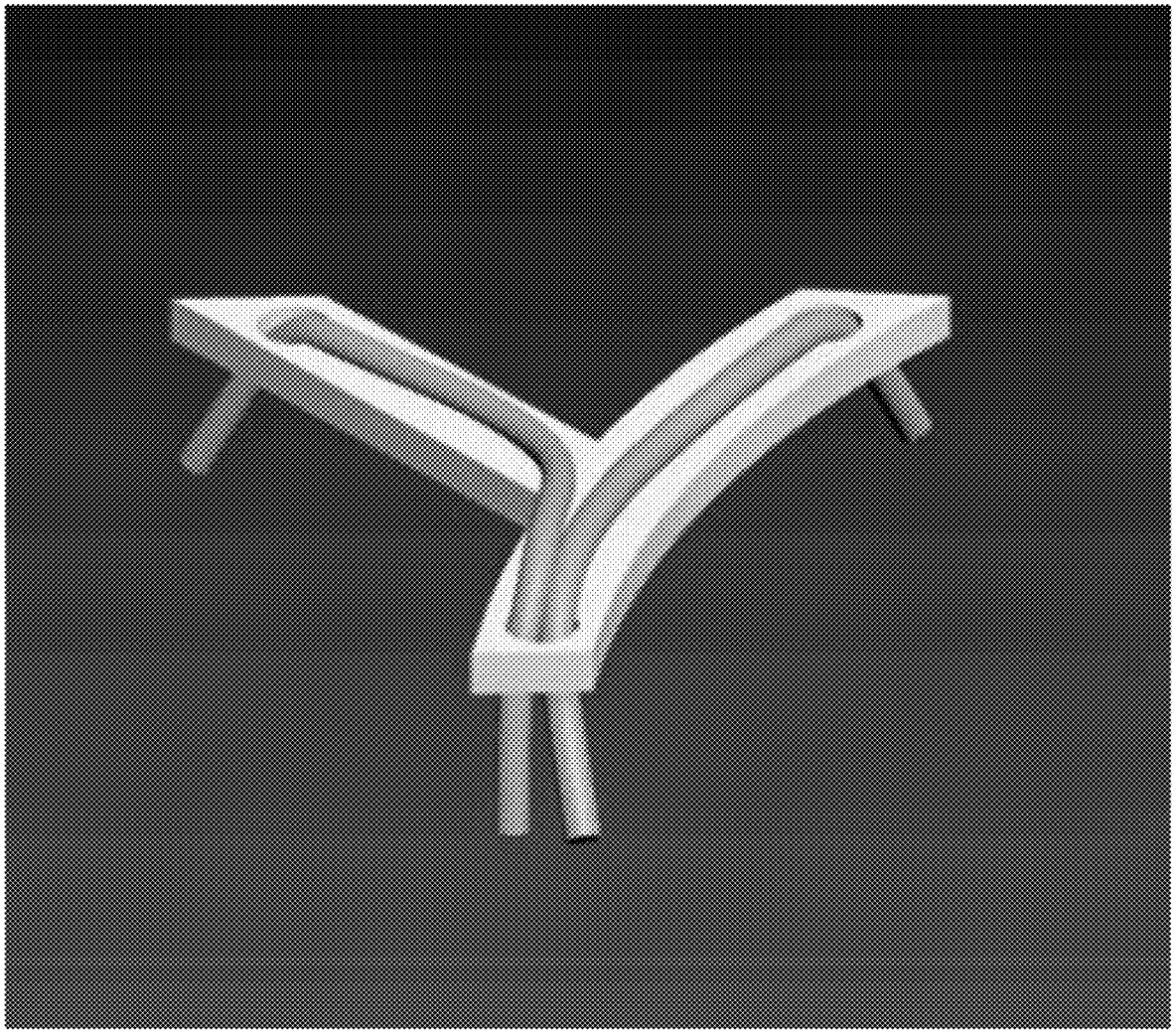
Figure 9:
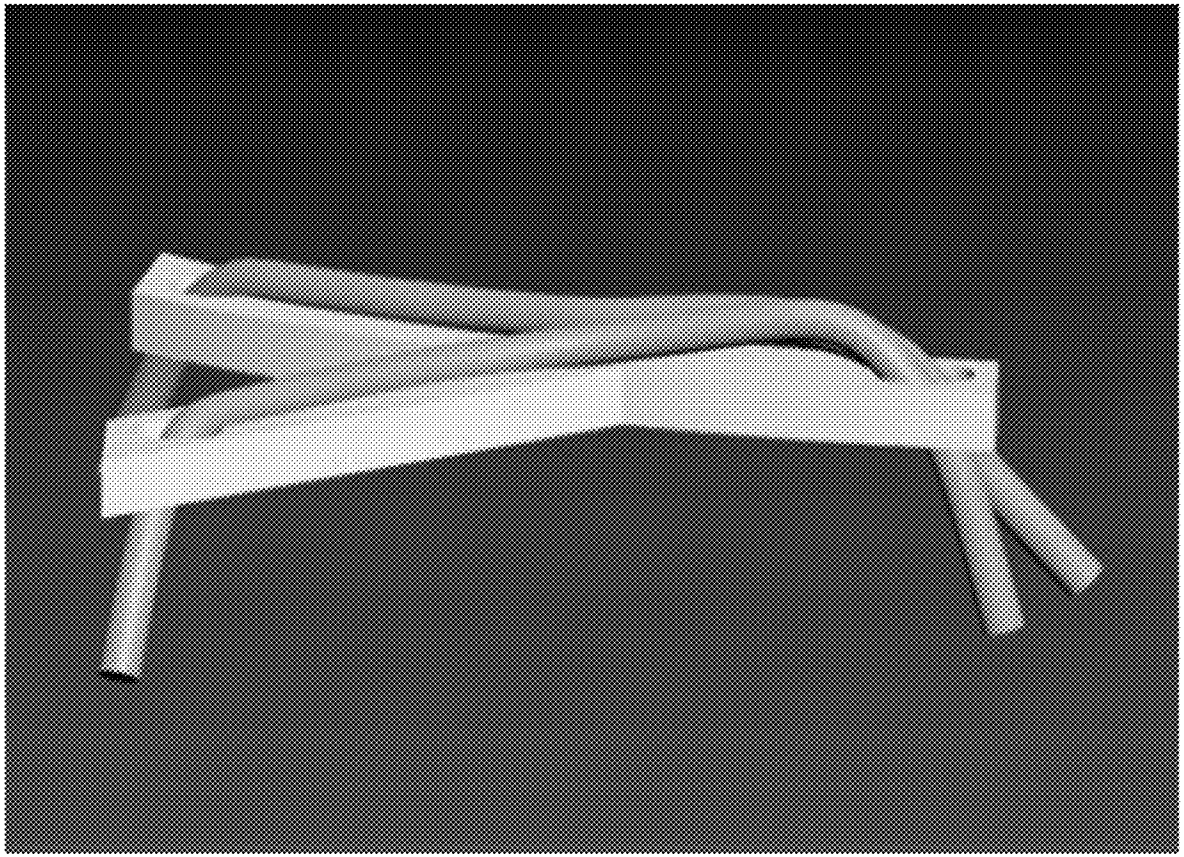
Figure 10:
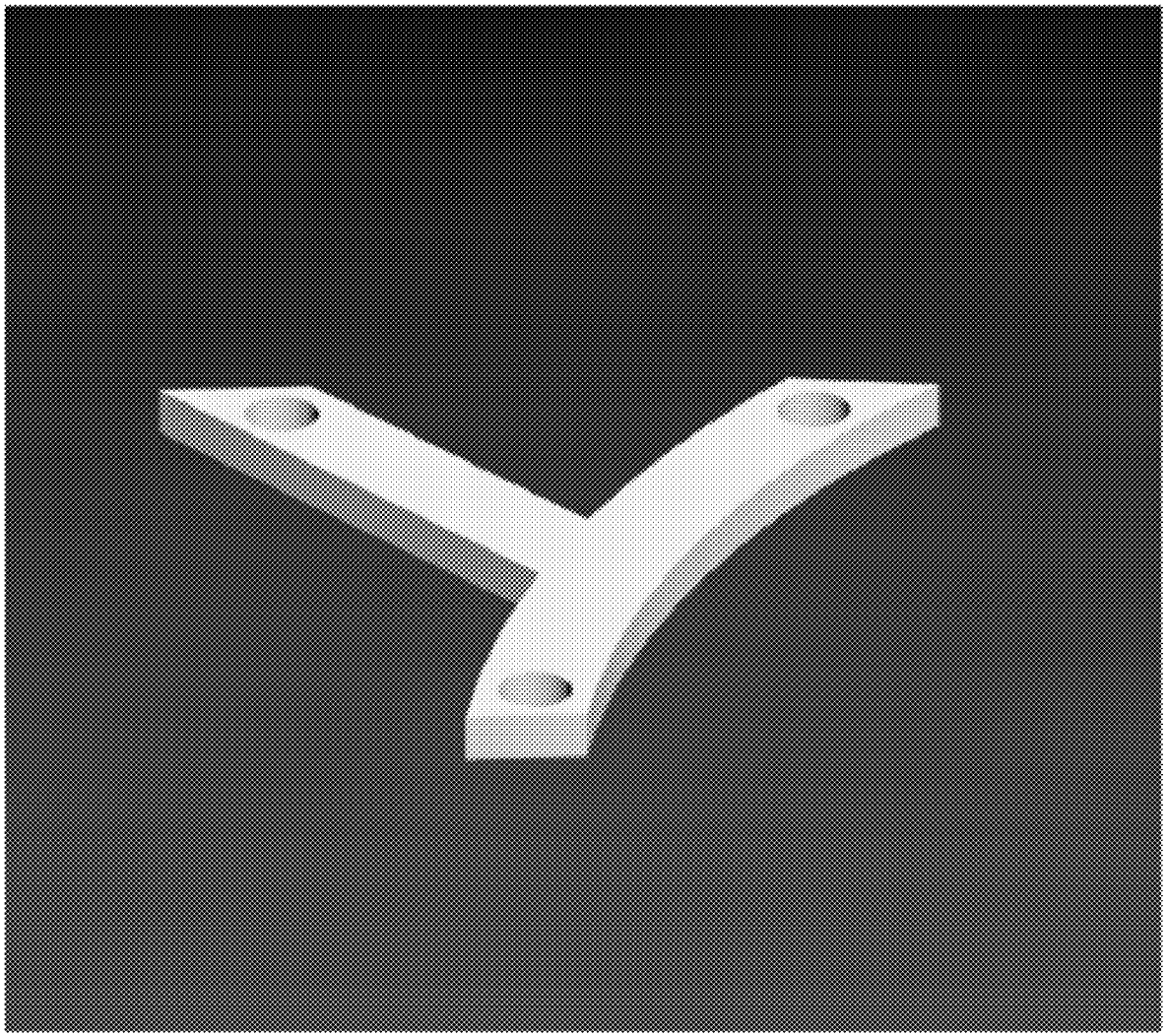
Figure 11:
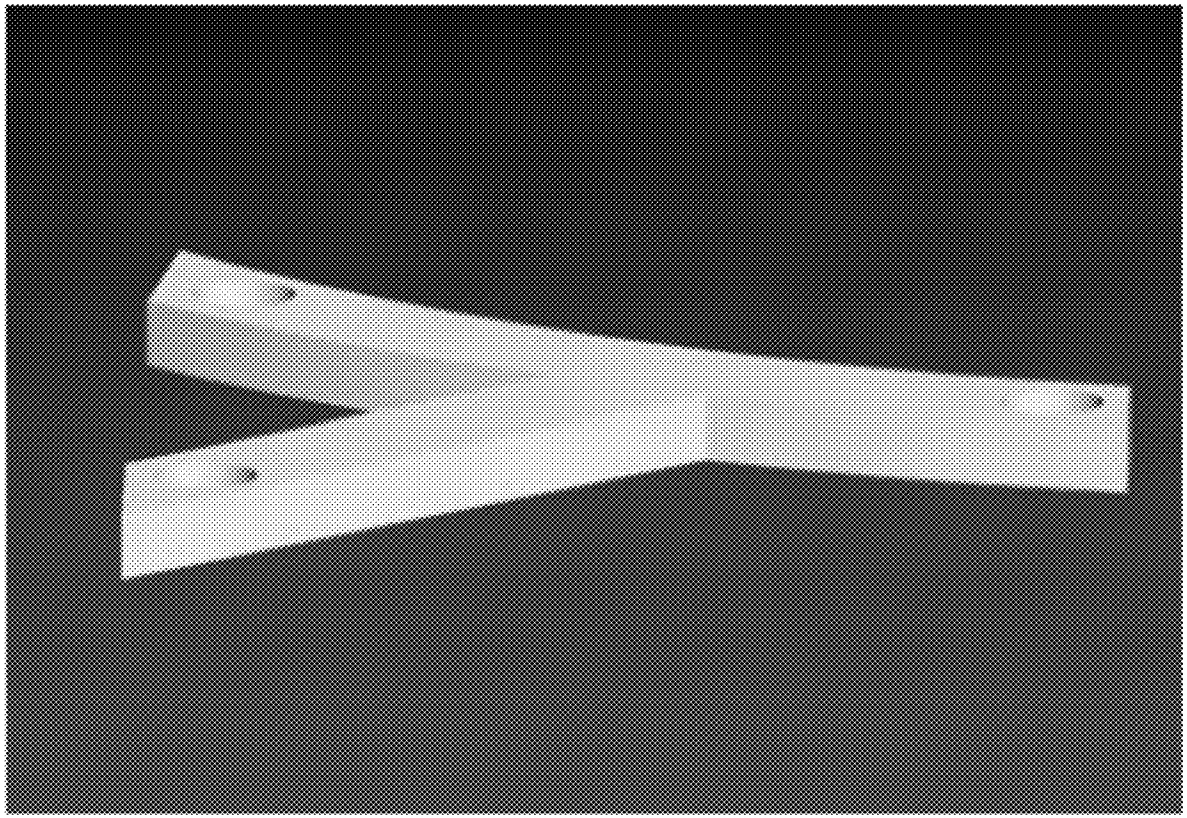
Figure 12:
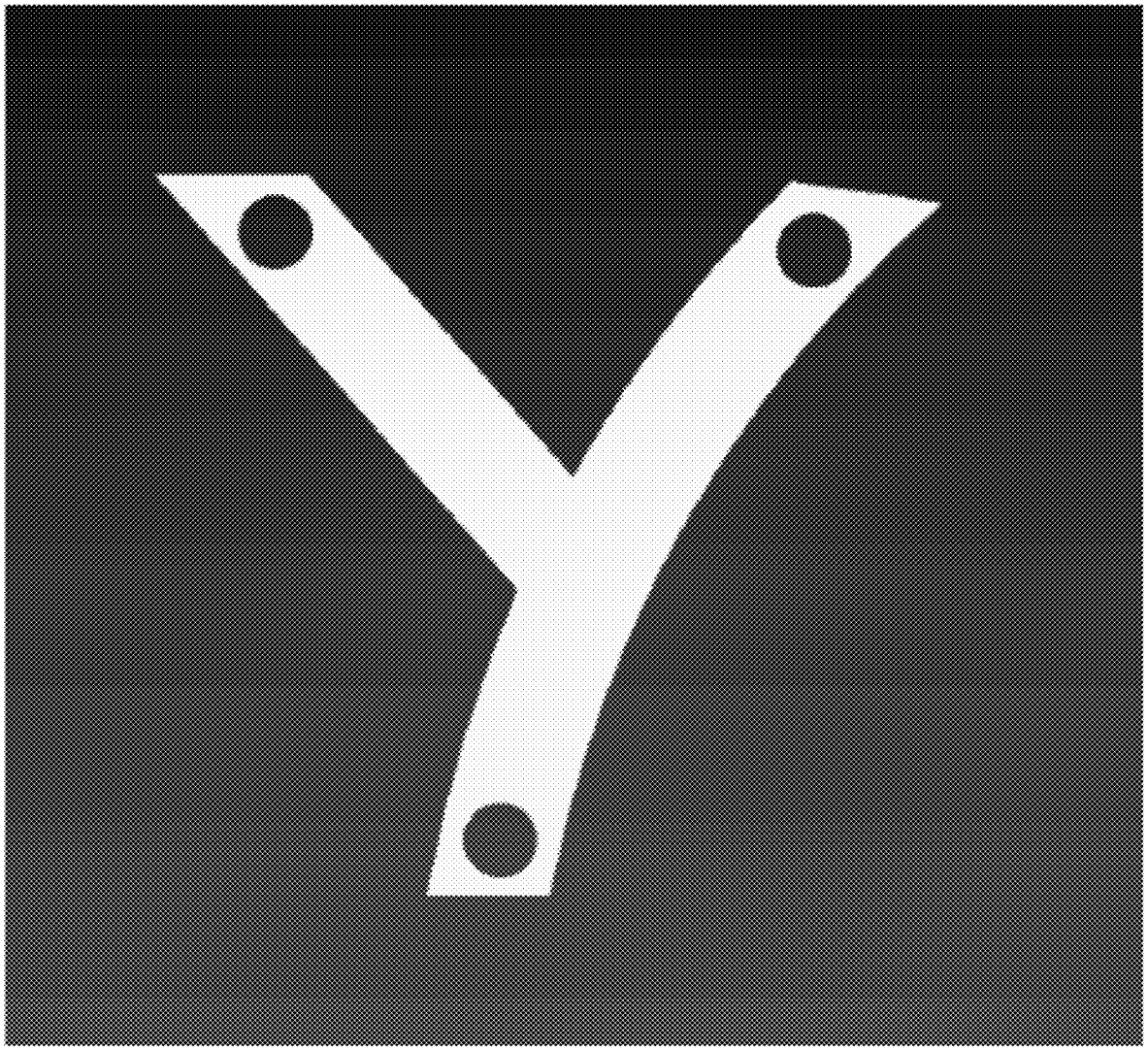
Figure 13:
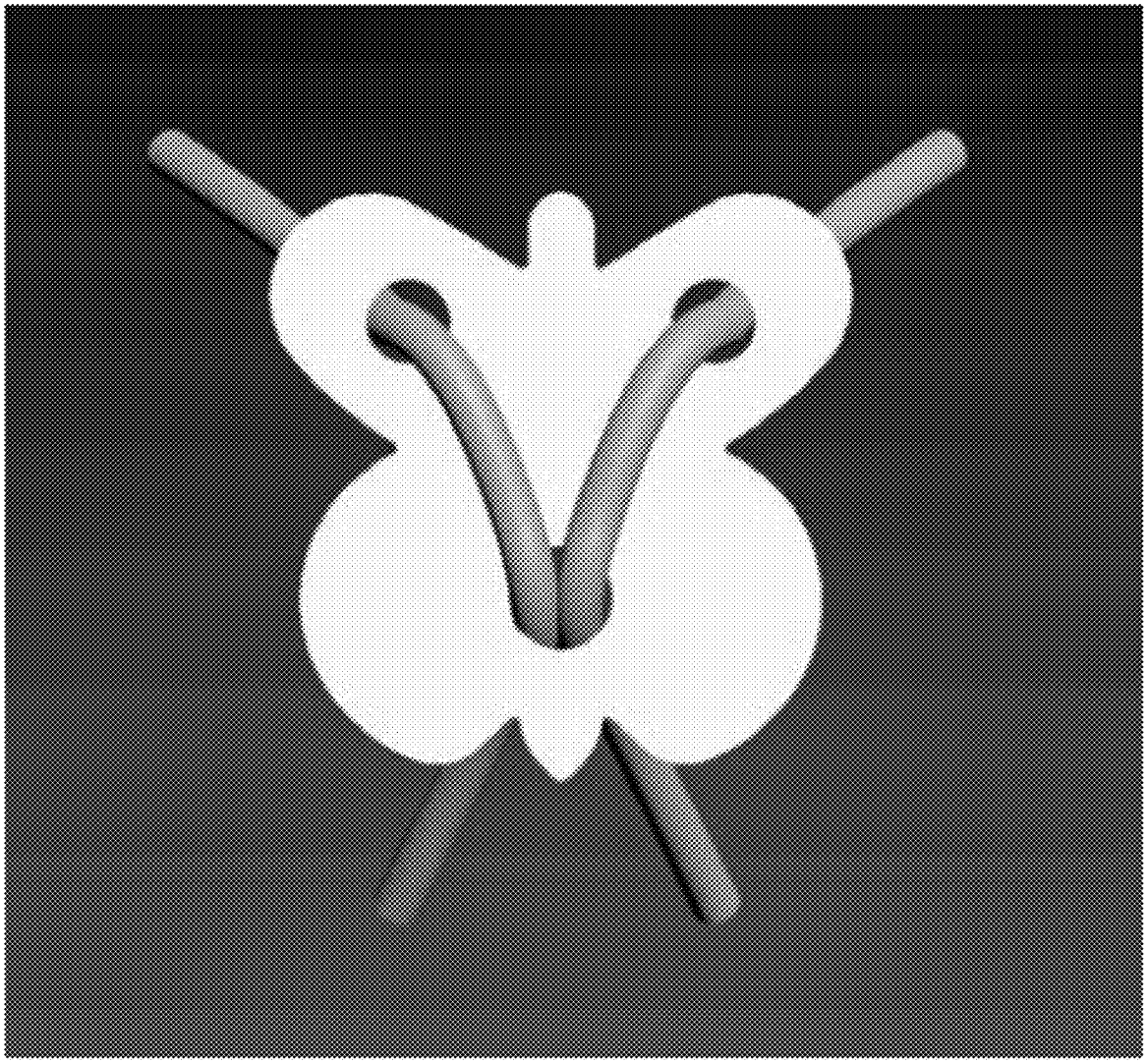
FIGS. 13-18 depict another embodiment of the device in a butterfly shape.
Figure 14:
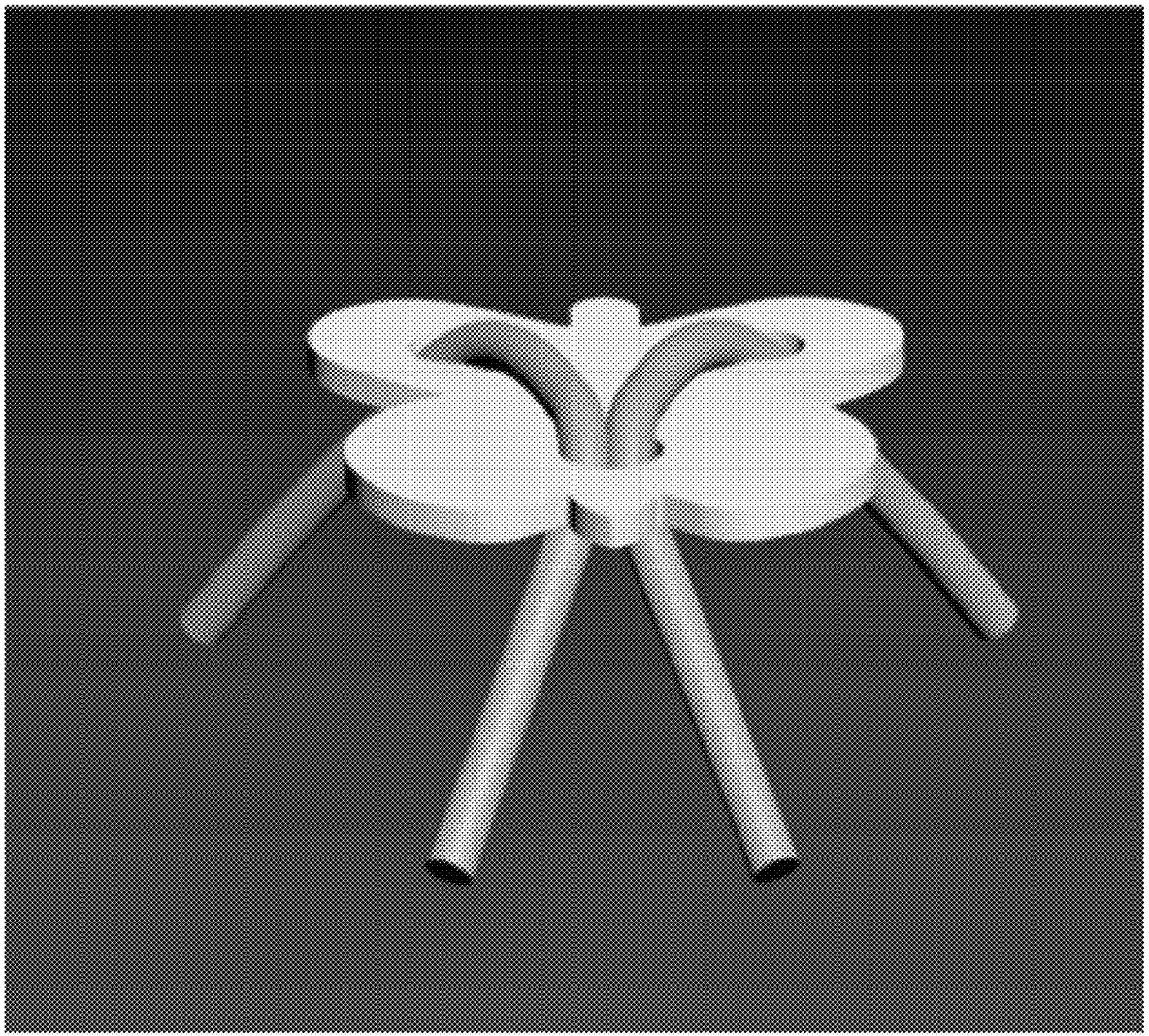
Figure 15:
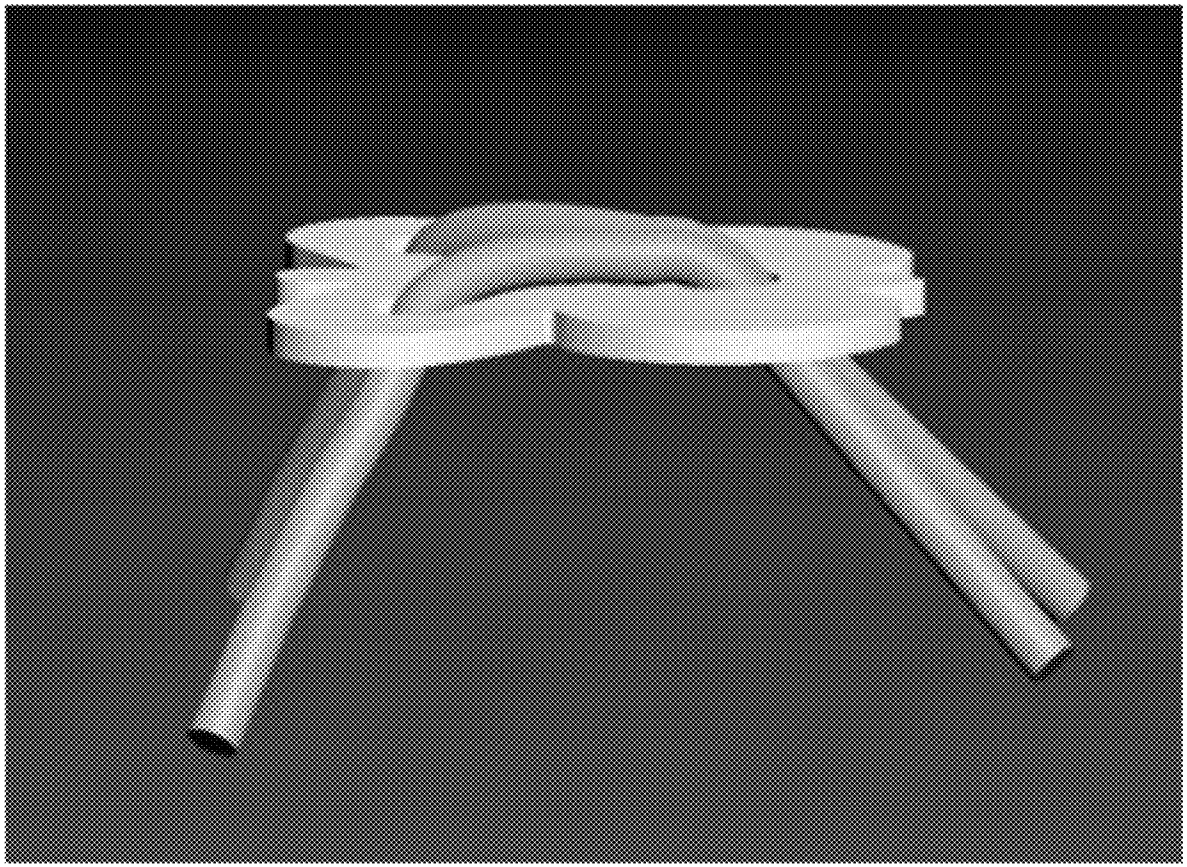
Figure 16:
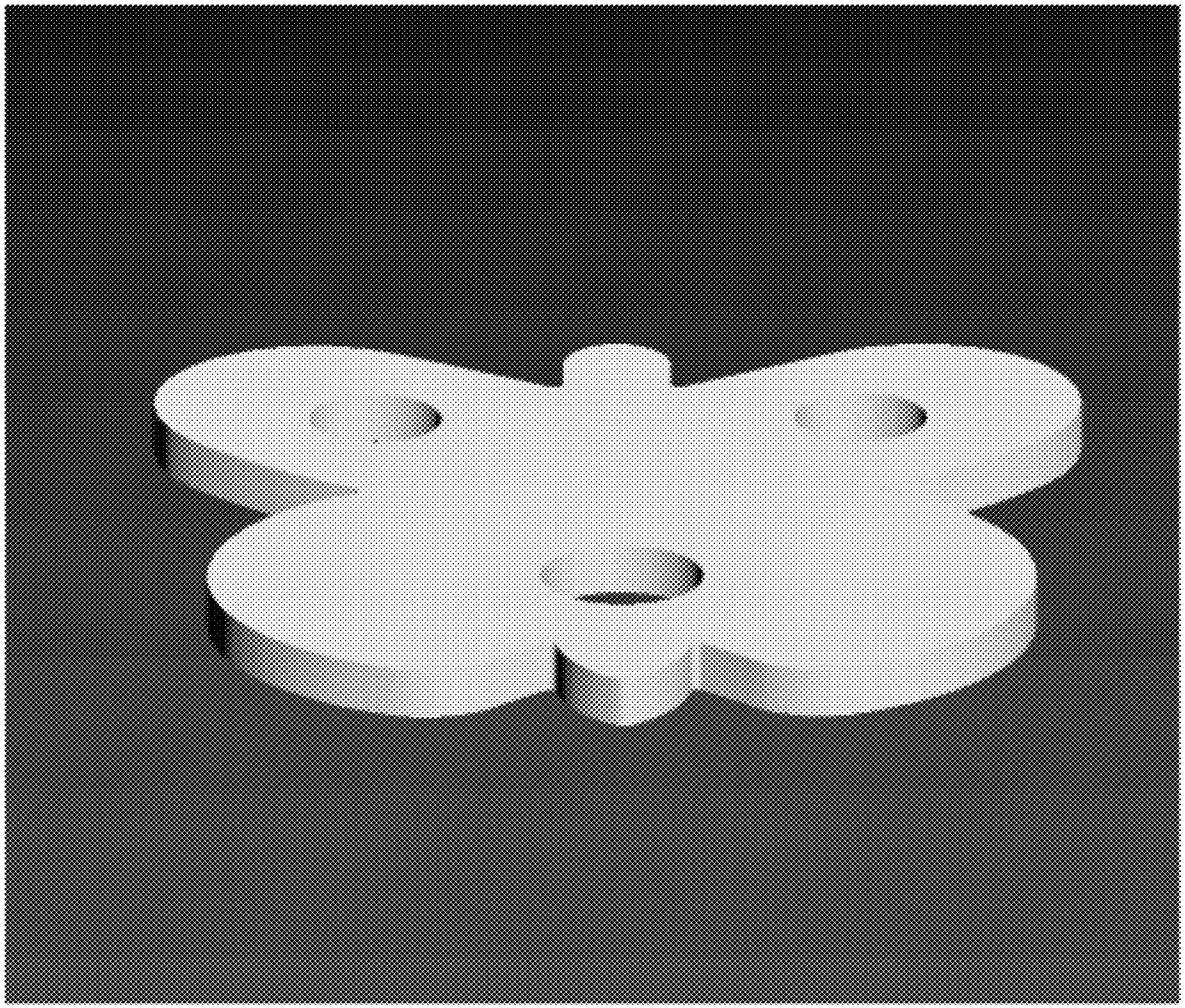
Figure 17:
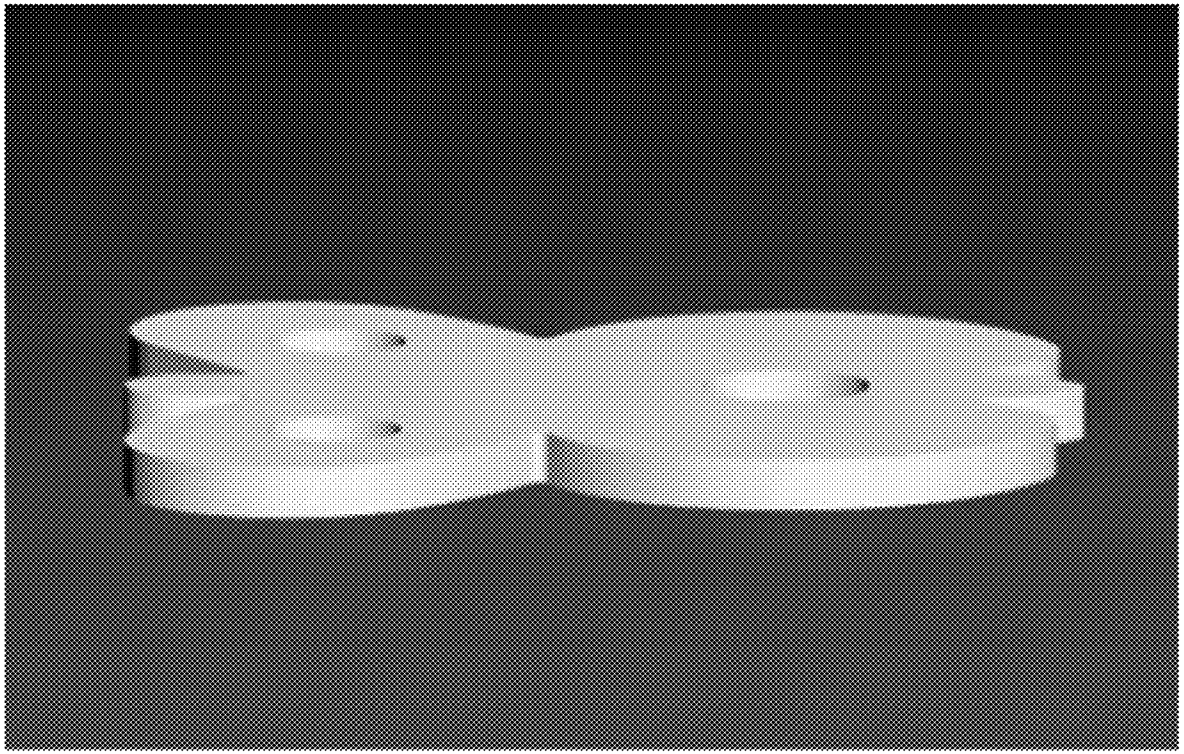
Figure 18:
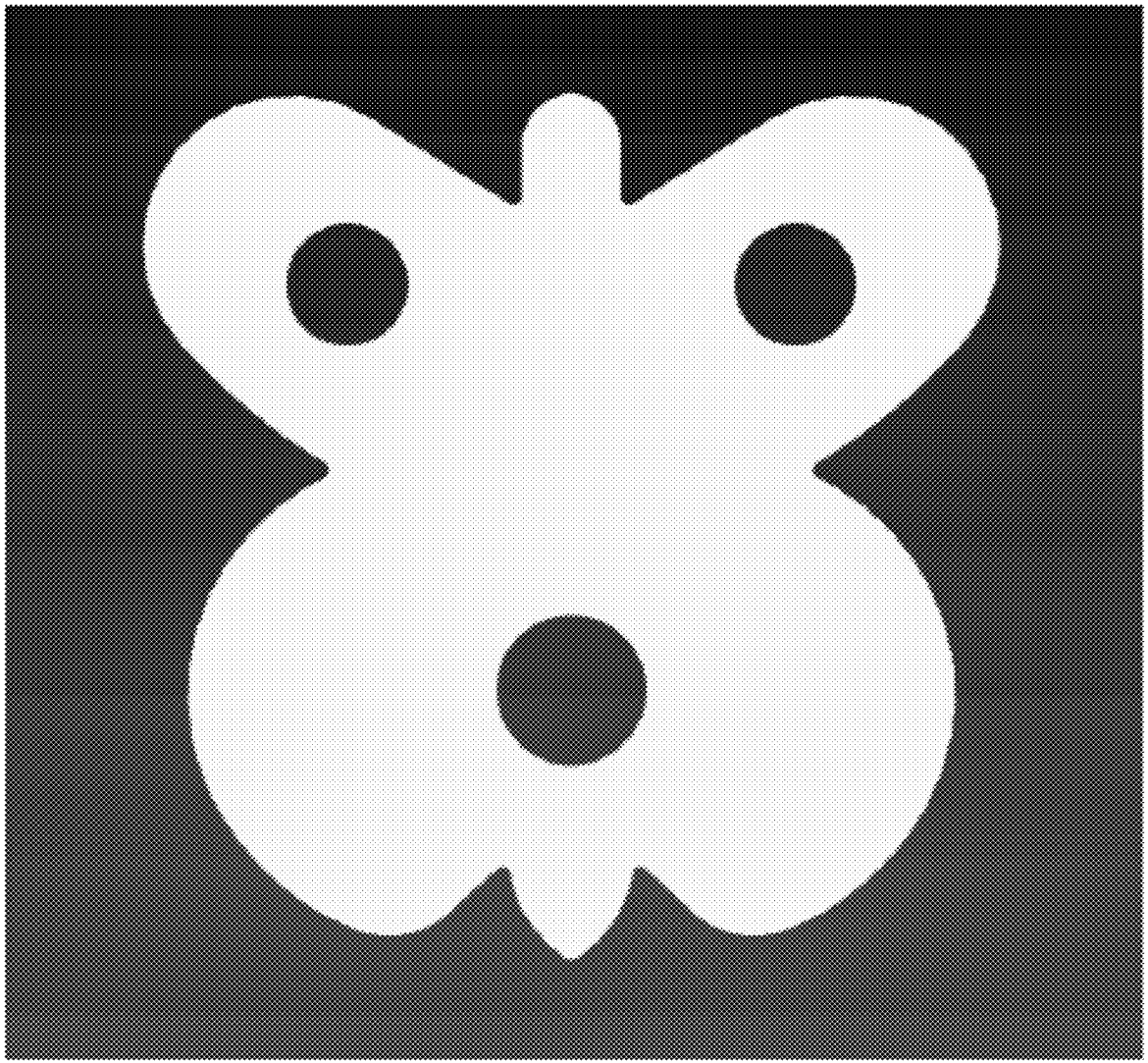

A neck strap force distribution device provides a comfortable mechanism for wearers to avoid tying a knot in the straps, such as of a halter top or providing a platform to dissipate the knot pressure. For purposes of securing the straps, in embodiments, the function may be similar in function to a bolo tie. The device provides a more effective mechanism, to loosen, tighten, or adjust in the straps, such as of a halter top. It provides protection for the upper spinal column. It also provides a medium to attach dangling jewelry or fashion accessories to the back of a wearer's neck. While the embodiments described herein generally refer to a halter top, any type of garment that requires connecting two straps (typically by tying a knot) generally in area near the back of a user's neck can benefit from this device.

We now reference FIGS. 1 thru 6 that depict plan and side views of the neck strap force distribution device 100. The overall shape of the device 100 as well as the relative placement and to some extent the size of entry holes 102, 104 and optional exit hole(s) 106 may affect performance. In an example, such as of a halter top, strings come from underneath the device 100. This first/underneath device surface (e.g., the rear surface not shown) may be an engagement surface due to the potential for this first surface to engage a back of a neck area of a user. In embodiments, each garment string enters upwards toward a second or resistance surface 108 through each of the entry holes 102 and 104 which are also viewed as the top holes when used as described. Both strings then go over the top/resistance side 108 of the neck strap force distribution device 100, which may provide resistance to movement of the strings, and the strings exit out a bottom exit hole 106.

The top entry holes may be sized so the garment string substantially fills the entire diameter of the entry hole. The bottom exit hole may be slightly larger than the top entry holes to accommodate both garment strings. The string routed through the top entry holes create friction between the garment string and the device. Both garment strings going through the bottom exit hole create additional friction that lock the device in place. As an example, the friction may be created by the garment/halter strings engaging portions of the perimeter of the top holes, contact with the outer/resistance/second surface of the device, and the set of strings again engaging the bottom exit hole perimeter. The friction is also created by both strings passing tightly through the bottom exit hole and being forced against each other by the inner surface of the exit hole. In embodiments, a first resistance force may be generated by engagement of the straps passing through the top/entry holes 102, 104. In embodiments, a second resistance force may be generated by engagement of the straps with the first/resistance surface 108. In embodiments, a third resistance force may be generated by engagement of the straps passing through the lower/bottom/exit hole 106.

In embodiments, the neck strap force distribution device materials may include a soft material like rubber, silicone, neoprene, or vinyl which is pliable and will take the shape of a wearer's neck, thereby dispersing the pressure of the strings generally away from the spinal cord. A soft material may also provide additional friction against in the straps. A composite material like wood, metal, hard plastic, resin or something similar can be used, optionally in conjunction with the softer material used as backing on the first/engagement surface that may come into contact with the user's neck, upper back and the like.

In embodiments, the device provides a surface that is stable on the wearer's neck. Jewelry or any sort of fashion accessory can be clipped onto the neck strap force distribution device. It can be clipped to the top of the device or on either side of it. A fashion accessory may be clipped to one or both of the strings above the device or on the portion of the string that passes along the outer surface of the device between the upper and lower holes. Fashion accessories can also be clipped or attached directly to the surface of the neck strap force distribution device itself.

The top entry holes or the exit bottom hole can also be used to attach dangling jewelry, fashion accessories, or any other item that may want to be displayed on the back of a wearer's neck.

Figure 33:
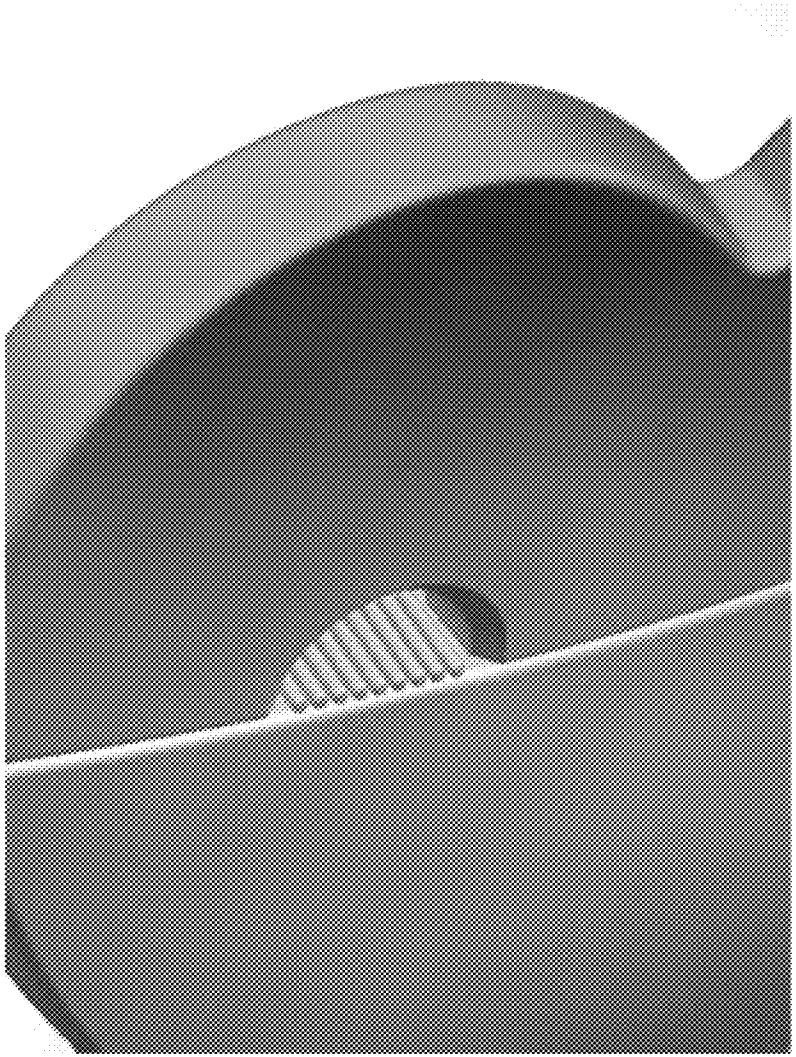

Any portion of the perimeter of the entry or exit holes may be constructed with a serrated surface 3302, such as is depicted in FIG. 33 to enhance resistance between the device and the garment strings. As noted in the description of FIG. 33, the serrated surface 3302 may extend over any portion of the perimeter of the entry and/or exit holes of the embodiments of FIGS. 1-6.

In embodiments, the device may include a slot extending from any of the entry and exit holes to a proximal outer edge of the device. In embodiments, the slot is a self-closing slot that facilitates capture of a garment string passed through it into a corresponding hole.

In embodiments, the device may be constructed in a range of sizes and shapes, sizes may range from small (e.g., 0.5 inches) to large (e.g., approximately 6 inches). The aspect ratio may be dependent on the shape. While exemplary dimensions and shapes are presented in FIG. 6 and described herein for pedagogical purposes, other shapes, sizes, aspect ratios, and the like are contemplated by the inventors and included herein. In an example, a device maybe configured for us with an animal, such as an ox. In such an example, the device may be substantially larger than 6" and may be formed from material and/or in a shape that is suitable for use with the ox.

FIGS. 7 thru 12 depict yet another embodiment of the device in a "Y" or similar shape. The device can take on various shapes with a 3-hole configuration that may function as the device embodiments depicted in and described in association with FIGS. 1-6. The device can also be made out of a variety of materials. The "Y" shape may also allow fashion accessories to be added. The same halter string configuration works with the "Y" as depicted in these figures. In embodiments, the vertical orientation of the "Y" may be reversed so that a single hole is disposed at the top of the deployed device. In embodiments, a halter string may be configured to pass from the bottom/first/engagement surface of the device on either arm of the "Y" through the corresponding arm entry holes 702, 704. In embodiments, the strings may come over the top/second/resistance surface of the device and exit out the optionally slightly larger bottom exit hole 706.

Generation of friction, such as by the techniques for first friction, second friction and third friction as described above may facilitate stabilizing the device in place. Accessories can be attached to either halter string, or one or more of the straps coming over the top surface of the device by passing the straps through the accessory before passing the straps through the exit hole 706 and the like, or may be dangled from the holes themselves. Fashion accessories may be clipped onto the "Y" itself using a clip similar to those found on a brooch. They can also by looped through the juncture of the "Y" itself. Accessories may also be pinned through the holes or designed specifically to attach to the device.

FIG. 13 to FIG. 18 depict yet other embodiments of the device with a butterfly shape. While the size and shape may be other than the specific butterfly shown, any shape that supports two upper entry holes and a typically larger diameter lower exit hole may be used. As described above, the 3-hole configuration contributes to generation of friction between the straps and the device to avoid requiring tying a knot.

A knot can still be tied by passing strings through the top entry holes, then tying the knot above the outer/second/resistance surface of the device. The surface area of the device is, in embodiments larger than the knot, so it will continue to dissipate the force of the knot. Jewelry and fashion accessories can still be pinned, clipped, looped, tied or fastened to the "butterfly" shape, similarly to how they may be attached to the other device embodiments.

FIGS. 19 thru 33 depict rigid and semi-rigid embodiments of the neck strap force distribution device. When a more rigid material like plastic, wood, metal, resin, hard rubber, composite materials, etc. are used in manufacture, the hole configuration can be different than when soft materials are used. Rigid materials can be used to provide greater detail of features, edges, holes, latches, hinges, and the like.

Figure 21:
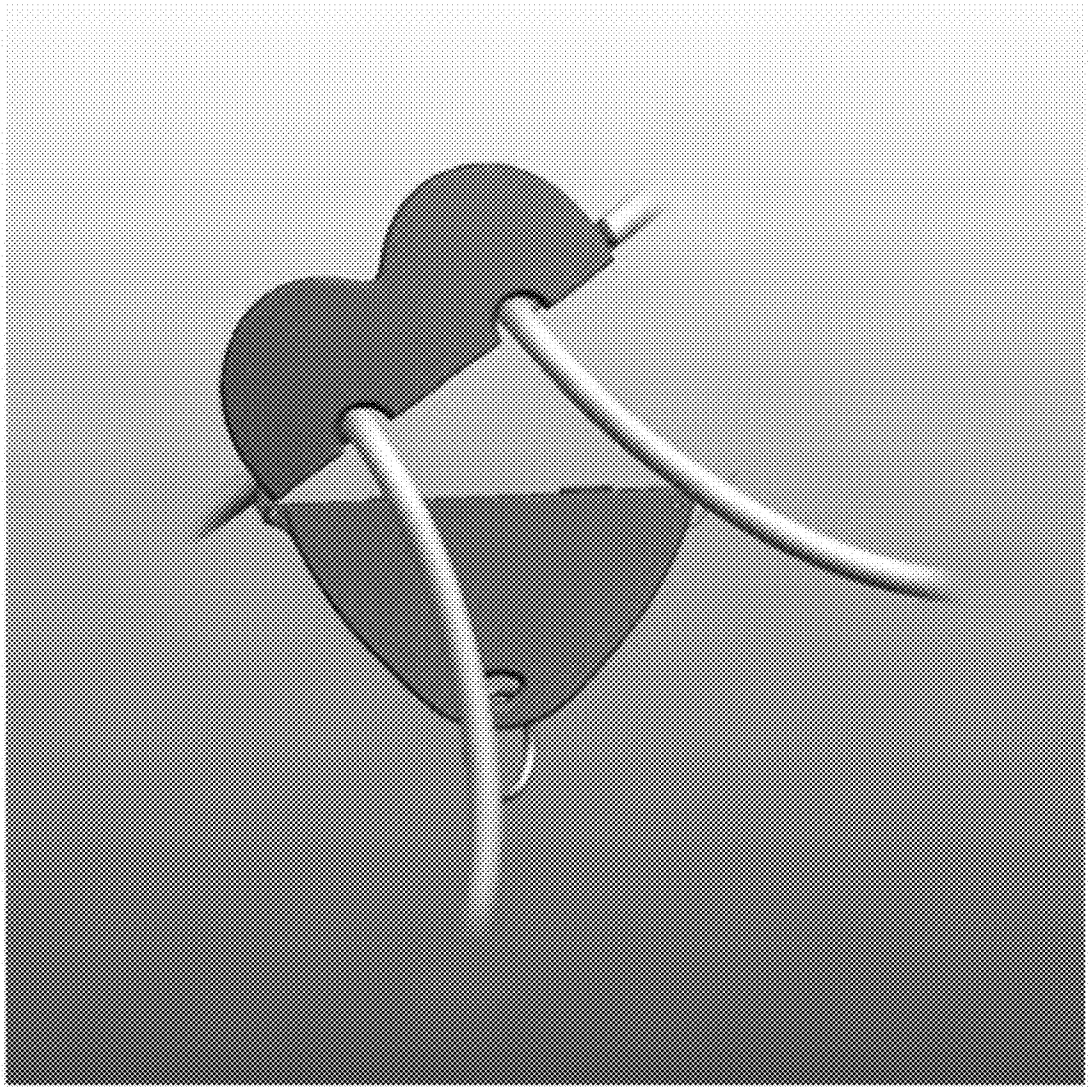
Figure 22:
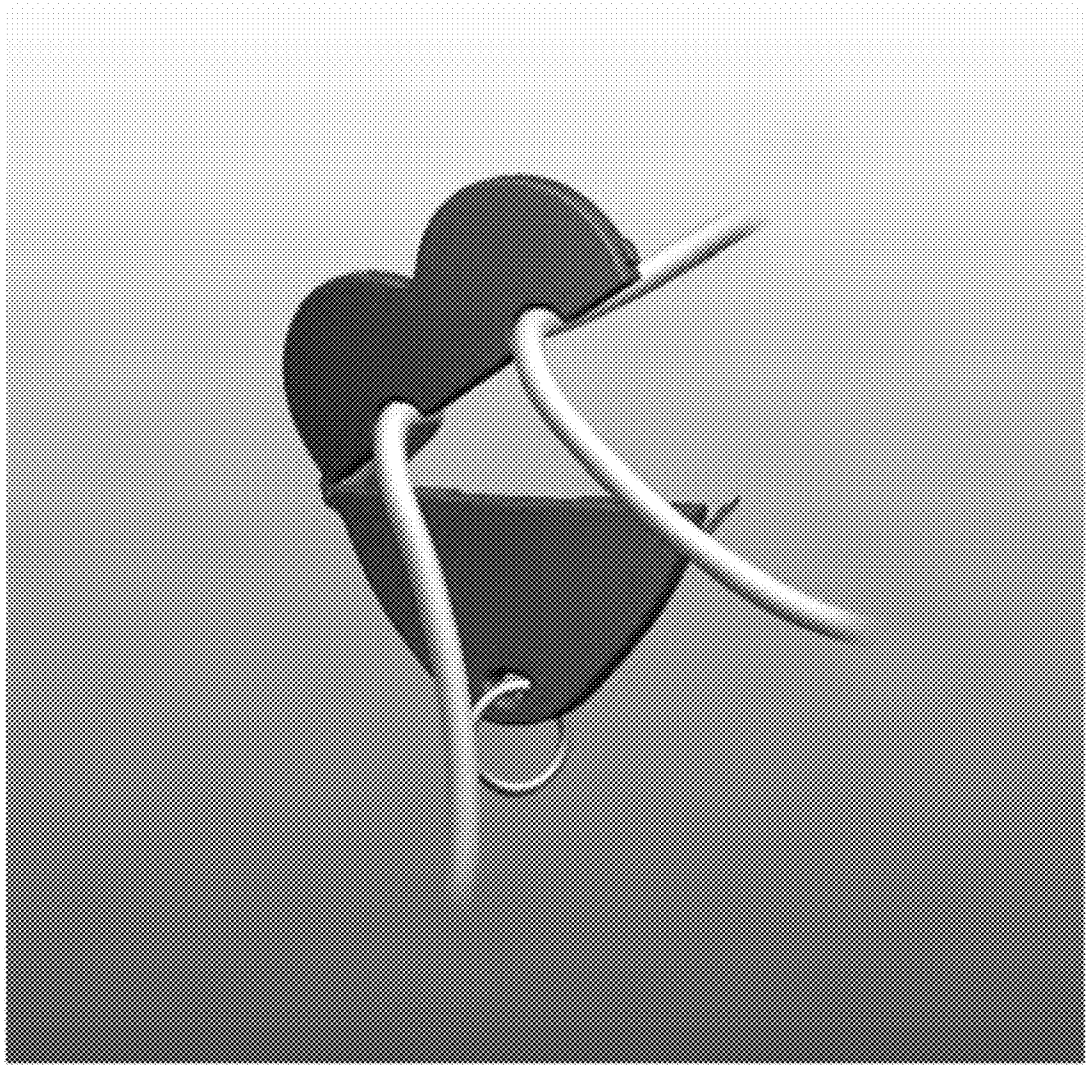
Figure 23:
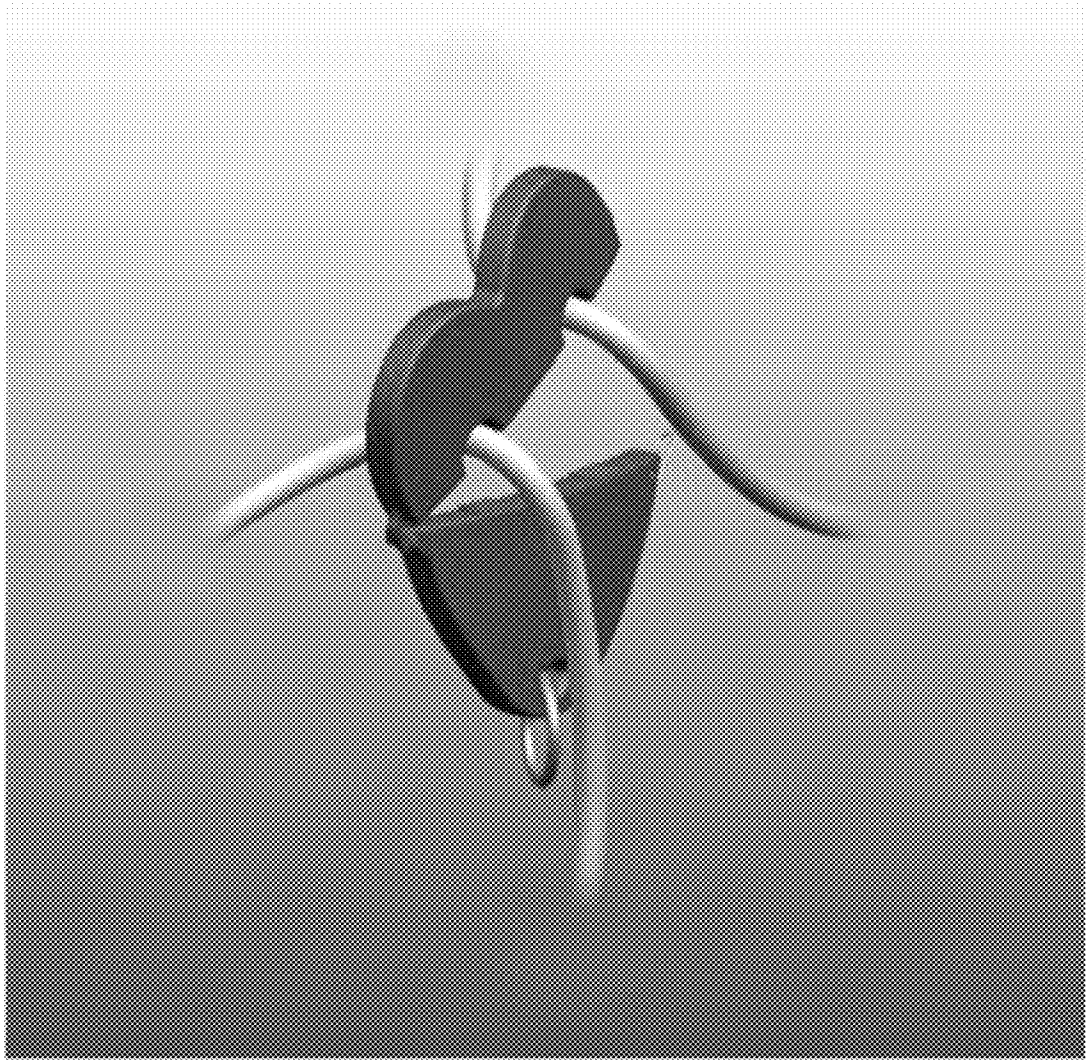
Figure 24:
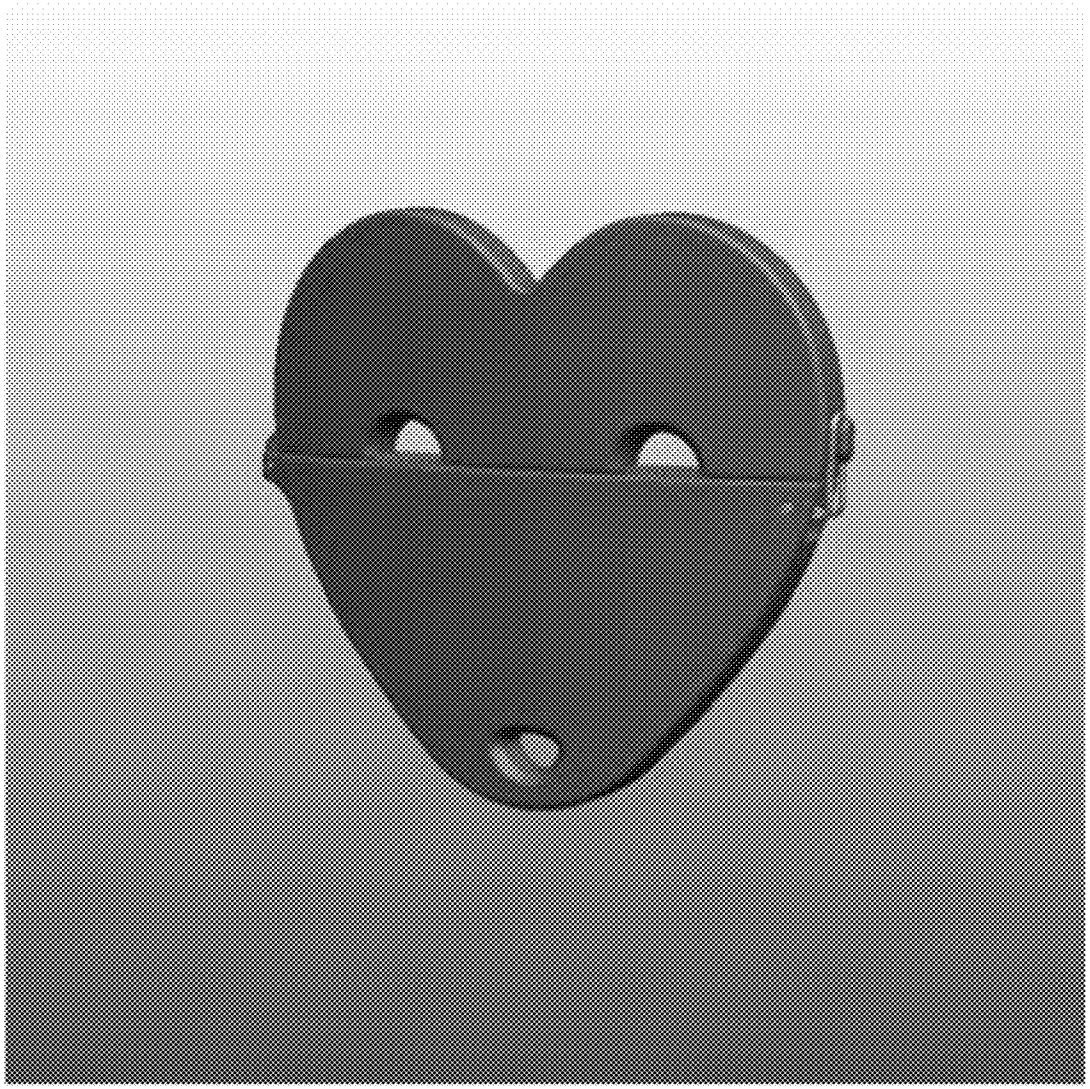
Figure 25:
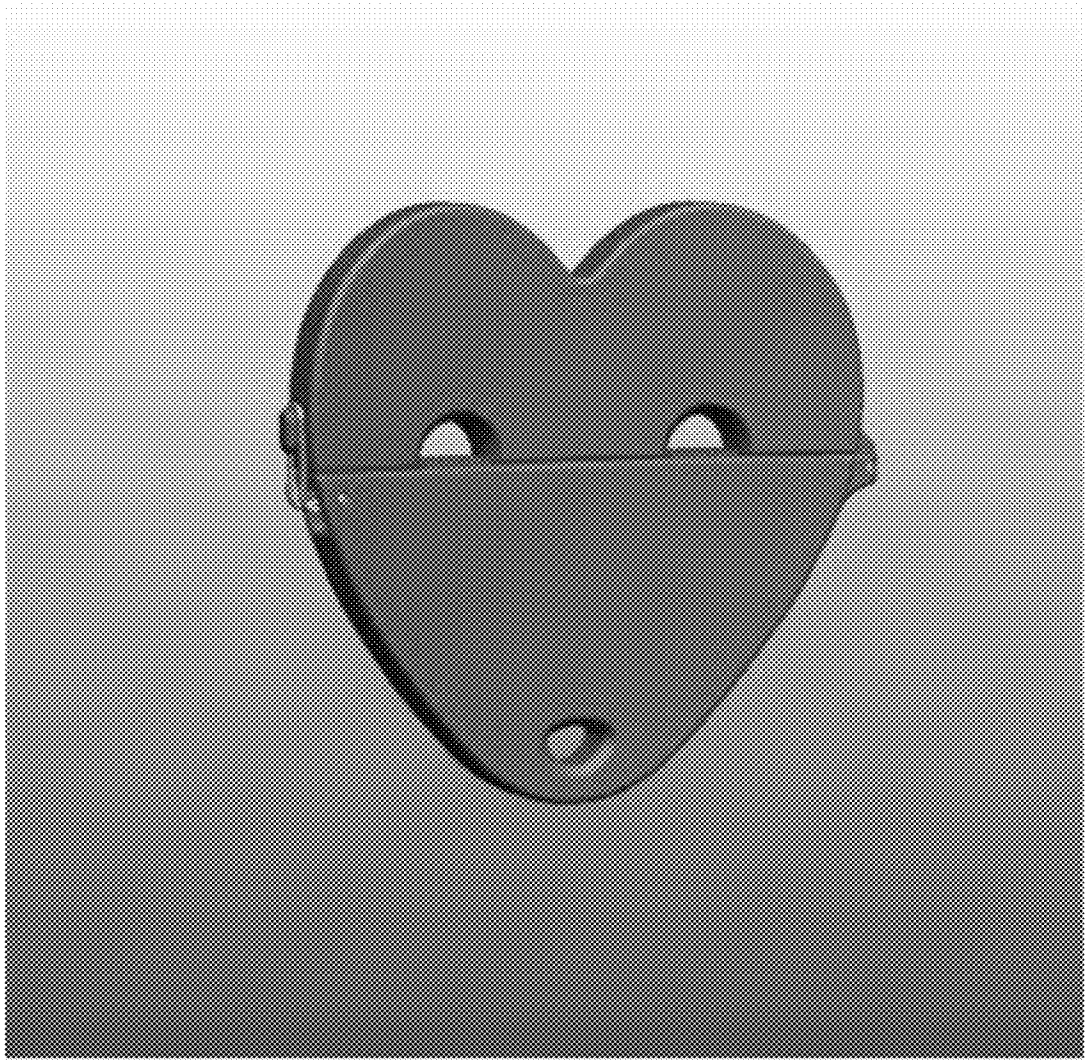
Figure 26:
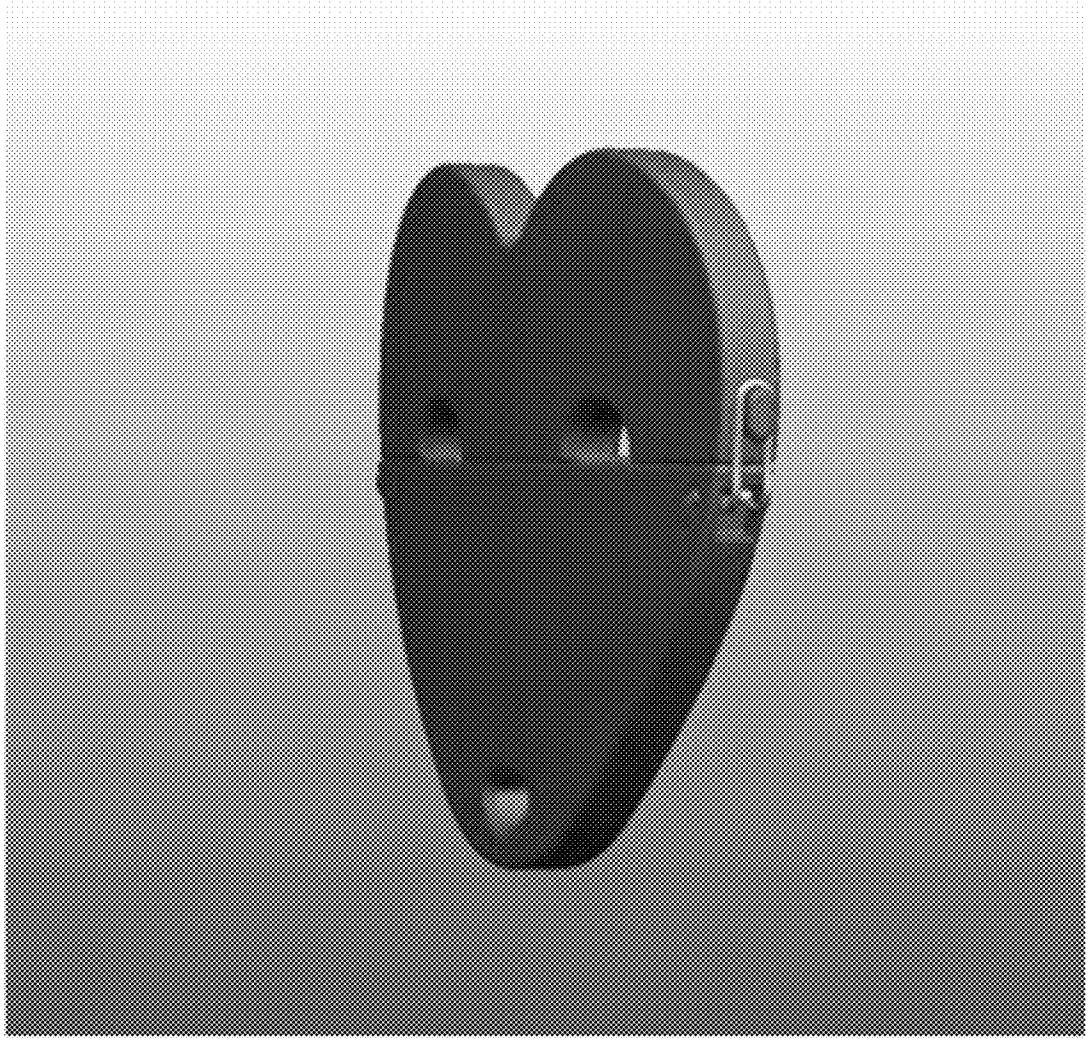
Figure 27:
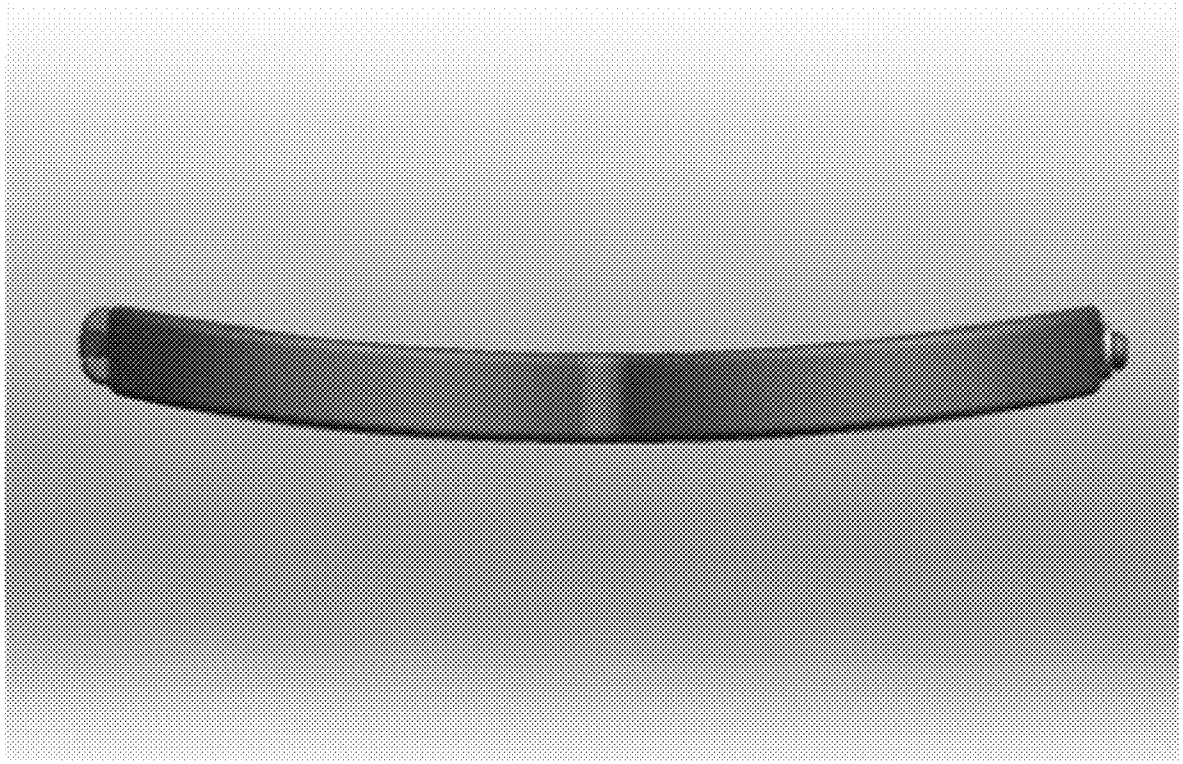
Figure 28:
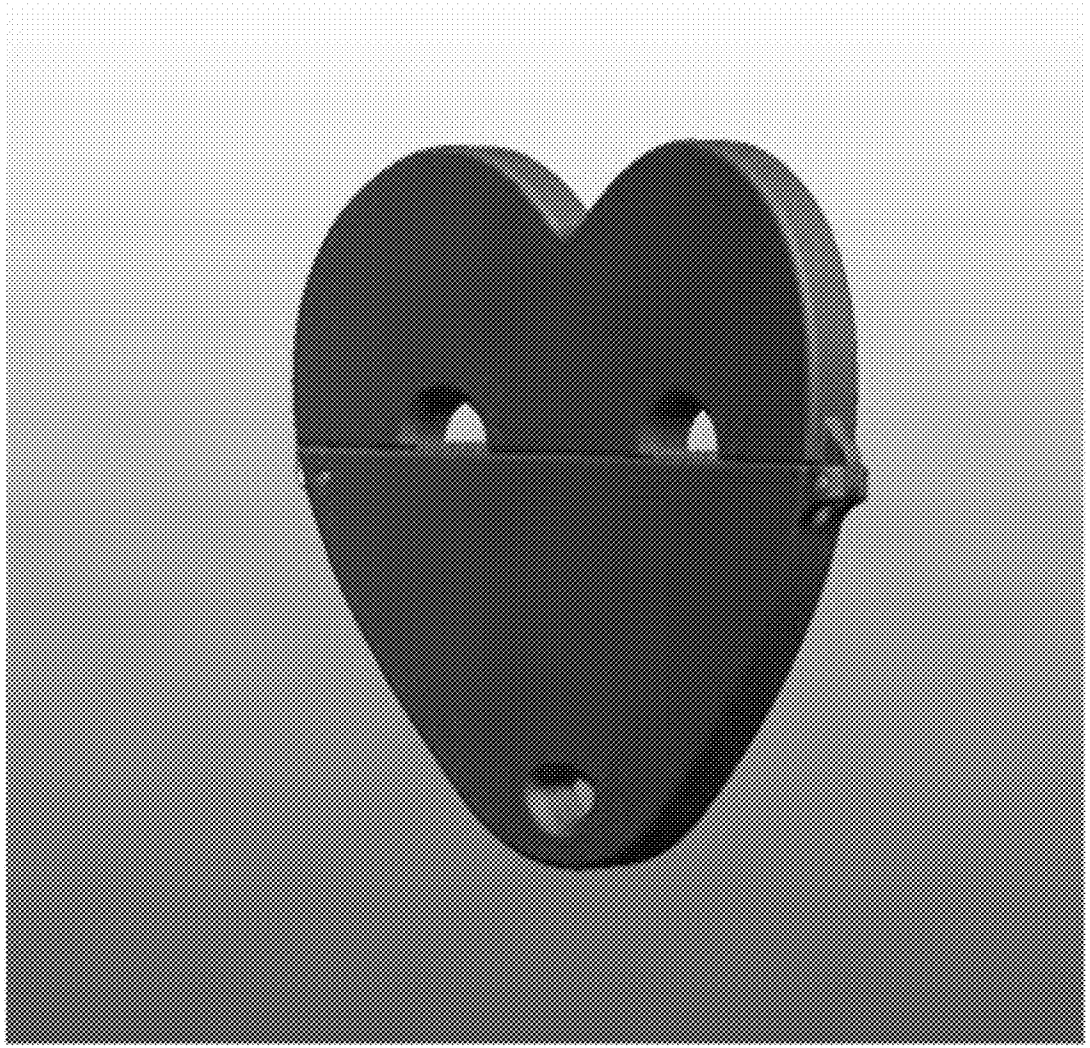
Figure 29:
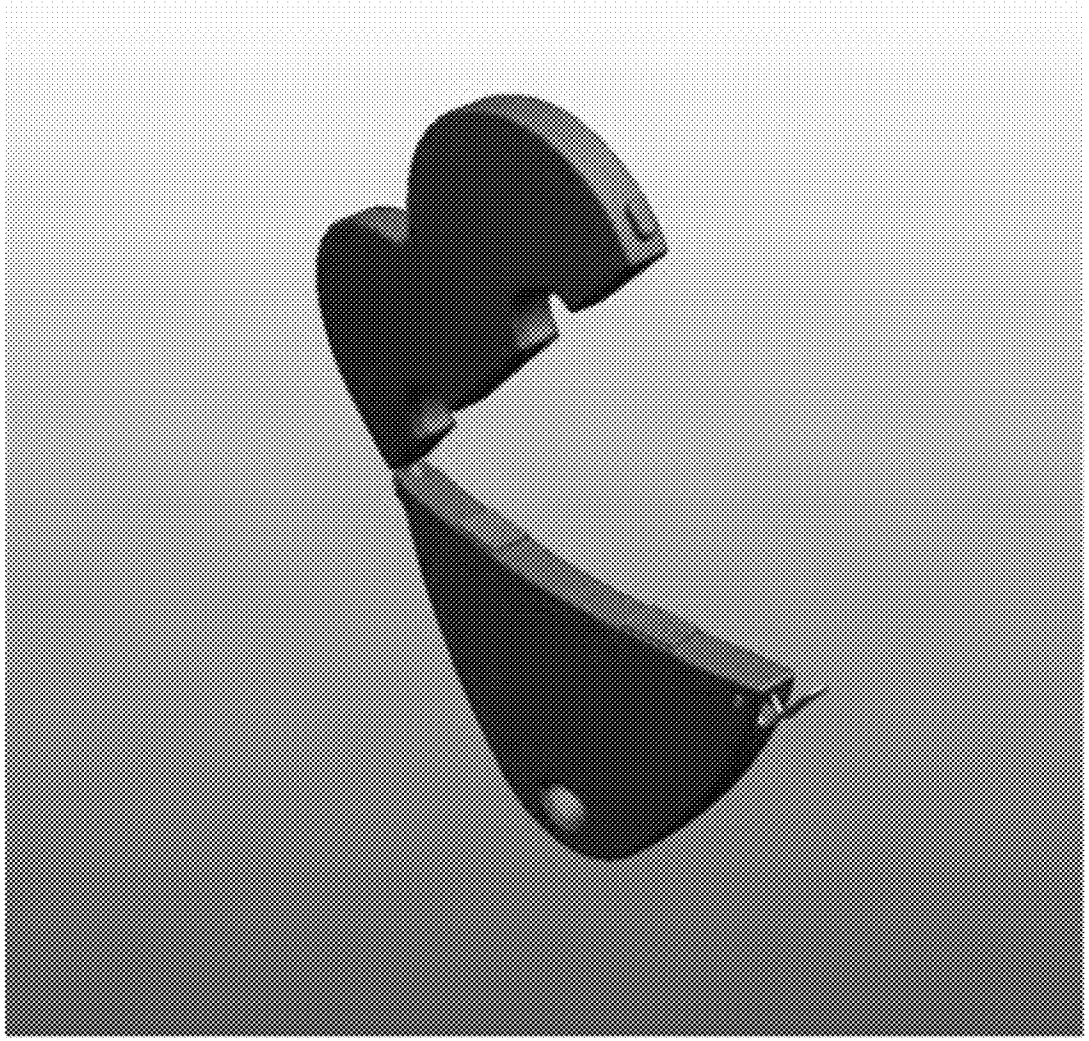
Figure 30:
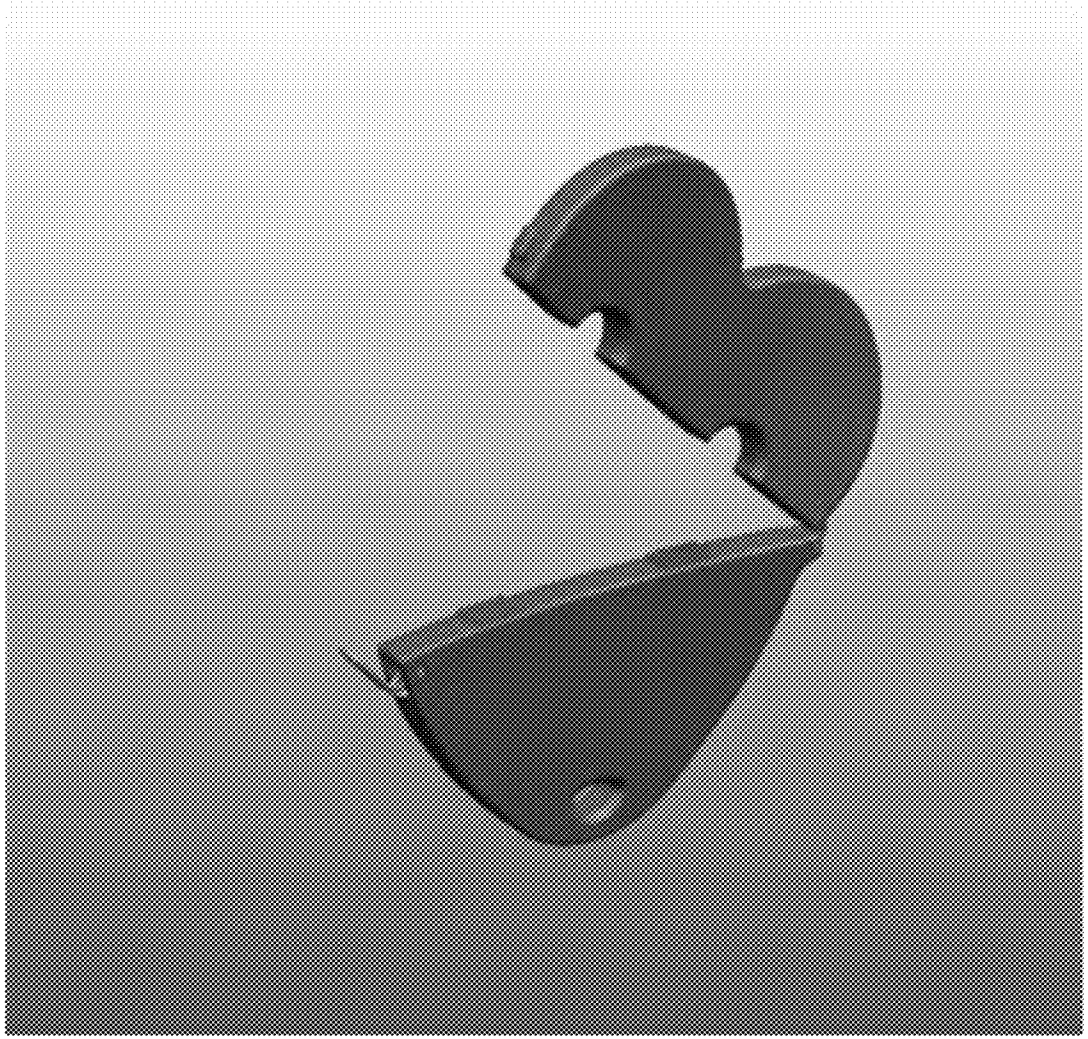
Figure 31:
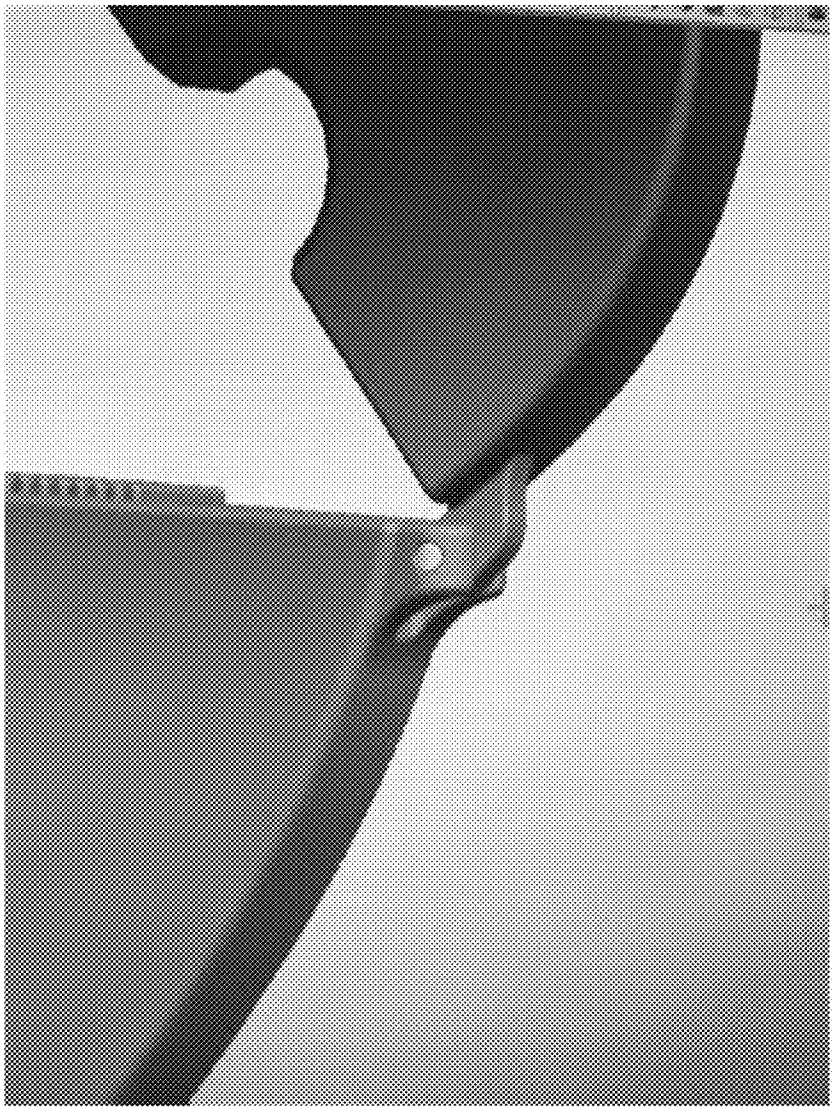
Figure 32:
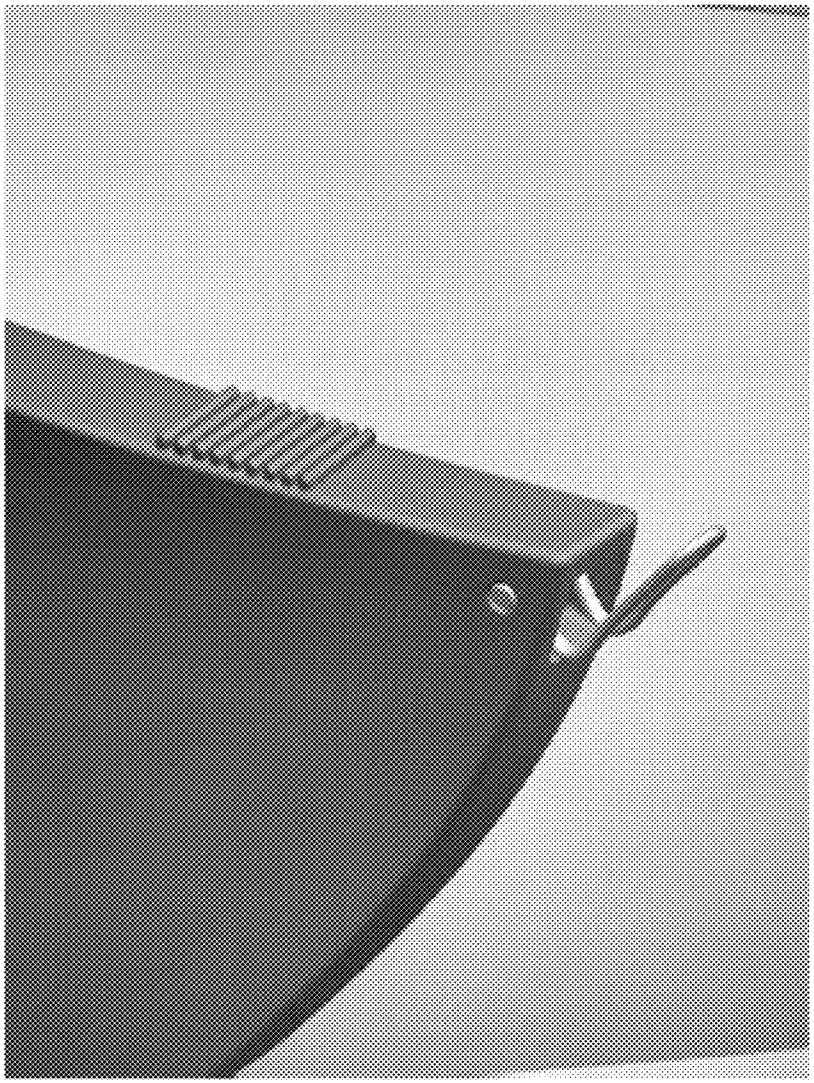

Rigid and semi-rigid materials also allow more stress and force on the device itself giving it greater versatility, such as for supporting heavier objects, like baby carriers, musical instruments (e.g., for marching bands), cross-body straps, aprons (e.g., household, industrial, commercial, medical, and the like), bib, protective body covering, and the like. The finer details that can be manufactured into the unit with rigid materials, might include a hinge for opening the device as depicted in FIG. 21. The detail in FIG. 31 depicts a metal hinge but will support different hinge materials or designs, such as plastic hinges, fiber hinges, interlocking portions of two pieces to form a hinge (e.g., tee and slot and the like).

In embodiments, rigid and semi-rigid materials may also support a clasp to lock the device when it is closed as in FIGS. 19-30 and 32. Such a clasp is detailed in FIG. 32 and as presented is made of metal, but can also be made of different materials or with different operational design, including fiber, plastic, rubber, and the like. The locking clasp opposite the hinge will provide additional tension on in the straps by forcing the strings against the perimeter of the holes.

In embodiments, the clasp and hinge may be positioned either on the left or right and may be differently positioned during use for reversible embodiments in which the device can be used with either the first or second side disposed toward a user's neck.

Any of the embodiments described herein may be constructed with a curved shape that orients the concave surface toward the back of a user's neck. This may be more comfortable on a wearer's neck (FIG. 27) and helps to disperse pressure of the strings away from the spine. The embodiment of FIG. 27 features the hinge and locking clasp opposite the hinge that will facilitate the holes providing tension on in the straps.

Figure 19:
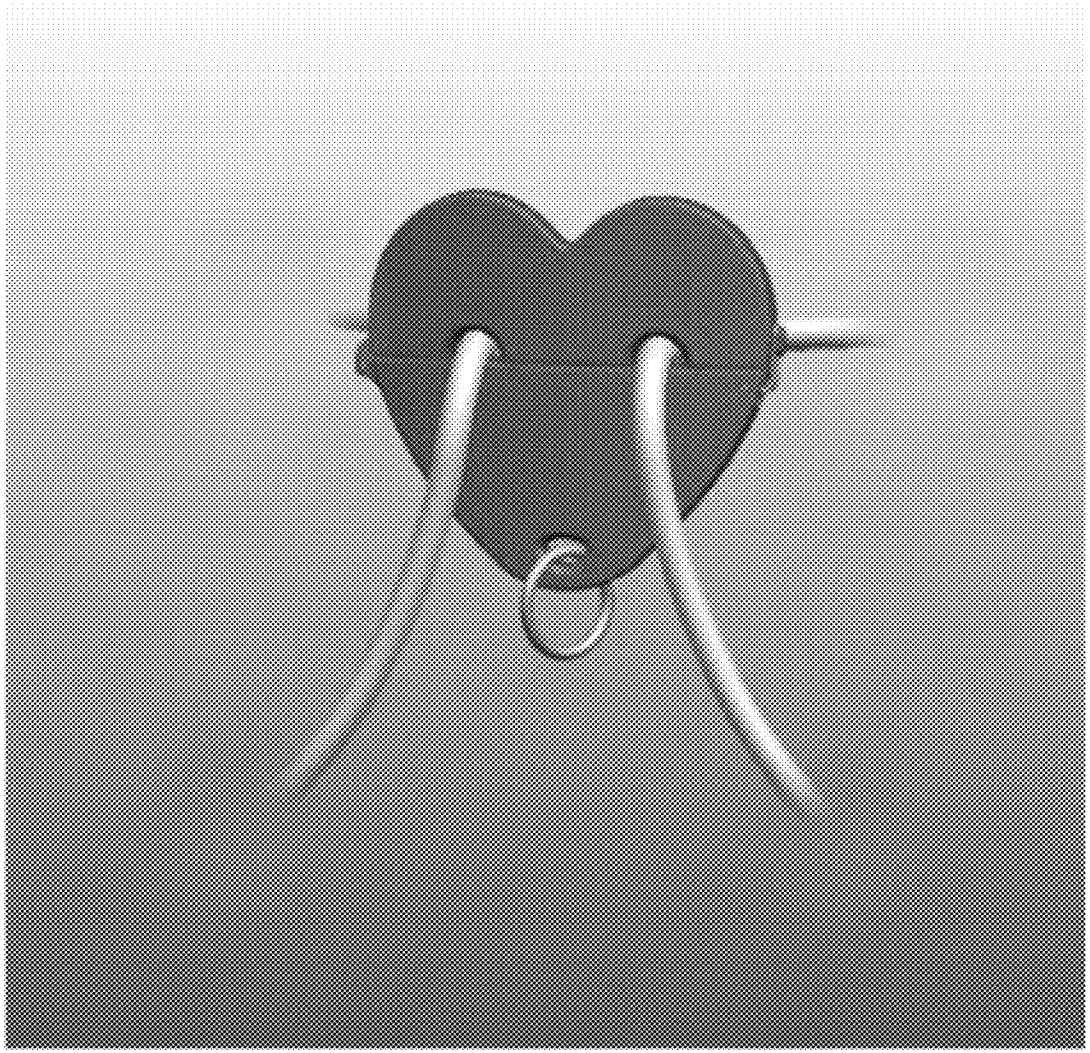
FIGS. 19-33 show a rigid or semi-rigid embodiment of the device.
Figure 20:
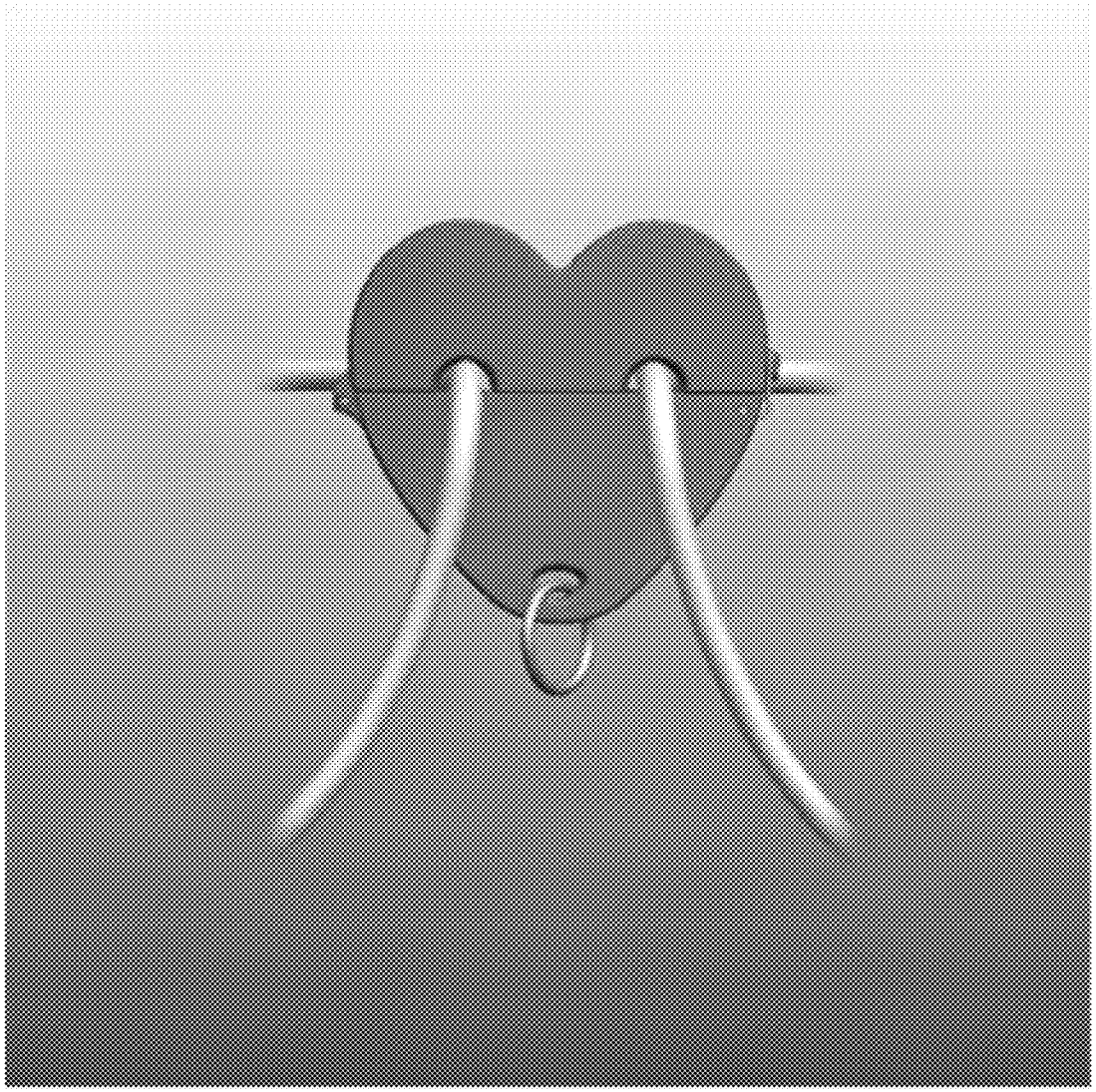

In embodiments, a 2-hole configuration pictured in FIG. 19 provides the comparable basic features and benefits as the 3-hole configuration of, for example FIGS. 1-6. In embodiments, friction between the device and the strings is still utilized to prevent the straps from slipping. In an example, serrated edges at the lower perimeter of the top holes may provide additional resistance to in the straps, and prevents them from slipping (FIG. 33). The orientation of the serrated edges may be aligned with the longitude of the depicted hole surface, traverse of the longitude (as depicted), or at another angle relative to the longitude.

In embodiments, the hinge depicted on the left side of the item in FIGS. 19-31 may allow the unit to be opened to release the straps. The two top strings of a halter pass through the top holes. In embodiments, the holes are serrated at the bottom to provide additional friction against in the straps, such as of a string. Any portion of the perimeter of the holes could be serrated, including the entire perimeter.

The serrated edge provides friction needed to keep the two halter strings from slipping. The serrated edge does not prevent users from tying an additional knot on the top surface of the device for additional support. The serrated edge is constructed in such a manner that it will not cause discomfort to the neck, nor will it pinch skin. In embodiments, the serrated material may be rubber, silicon, neoprene or other material. In embodiments, the serrated material may be a rigid material that "bites" into the garment string when pressure is applied, such as when the hinged pieces are closed and latched with the string passing through the serrated holes.

In embodiments, that generate sufficient first friction and second friction may free up the exit/third/lower hole for the user to hang a loop, hoop, pin, clip, or any other mechanism to fasten a piece of jewelry or attach an accessory.

In embodiments, these figures show a latch, such as latch 3302. The latch locks the neck strap force distribution device closed thereby ensuring sufficient pressure between the strings and the device hole perimeter to keep the device in place and prevent the straps from moving. This version may be preferred for workouts, dance, outdoor activities or any other activities that require a lot of movement by the user.

The neck strap force distribution device provides a comfortable and unique mechanism for, among other uses women's halter tops. Benefits of such a device include: providing an alternative to tying a knot; giving women the option to tie a knot without the pain and discomforted associated with knots; providing a more effective mechanism, to loosen, tighten, or adjust in the straps, such as of a halter top; providing additional support for women with larger bust sizes; providing protection to a wearer's upper spine; creating a unique tan line for women, if worn as a bathing suit accessory; use as a fashion accessory; providing a mechanism to attach dangling jewelry or accessories to the back of a wearer's neck.

In embodiments, the neck strap force distribution device is designed to improve the comfort of any halter top style bikini, blouse, dress or any other clothing item that may tie at the neck. It provides additional support to women with larger busts. It reduces neck discomfort and pain normally associated with tying a knot on a halter top.

In embodiments, the neck strap force distribution device achieves this by dissipating the impact and pressure associated with a knot over a larger surface area. The surface area spreads the pressure of the knot over several square inches. The device allows women to use friction to act as the fastener and secure their halter top rather than the traditional knot. They can still tie a knot if they want added support. The neck strap force distribution device will also dissipate the force of a traditional knot.

In embodiments, the neck strap force distribution device also acts as a more effective adjustment mechanism. The traditional knot takes time to tie and only allows a tight or loose adjustment. The neck strap force distribution device allows adjustments at fractions of an inch at a time, providing the opportunity for a perfect fit, regardless of bust size. Once the neck strap force distribution device is attached to a bathing suit, there is no need to ever remove it. Women can simply loosen the neck strap force distribution device and duck their head out to remove in the straps, such as of a halter top.

In embodiments, the neck strap force distribution device will provide additional support for larger bust sizes. Women with larger busts suffer from headaches, muscle pain, and even painful disfigurement from traditional halter tops. Sometimes they are forced to "over tighten" the lower strings (straps) because upper strings will loosen. This causes pain and red marks around the rib cage. Wires, padding, and forms are added to bikinis and bras to alleviate this issue.

In embodiments, the neck strap force distribution device mitigates the need for these extra items and won't force a wearer to "over tighten" her lower strings.

In embodiments, a second neck strap force distribution device can also be used to fasten the lower strings of a bikini or halter top.

In embodiments, the neck strap force distribution device provides added protection to a wearer's neck and spinal column. The material is soft and playable and will absorb any low impact shock to the area.

In embodiments, when the neck strap force distribution device is worn with a bathing suit, the neck strap force distribution device can be manufactured in several shapes and sizes. These shapes can be circular, heart, butterfly, "y", rainbow, triangles, letters, or any other shape. These shapes will provide unique tan lines on the back of a wearer's neck. They can be used as a fashion accessory and offer something more unique than normal bathing suit tan lines. Similarly, the thickness of the device (as measured from the first surface to the second surface, and the like) may range from several millimeters to a few centimeters or greater without compromising the basic features and functionality described herein.

In embodiments, the neck strap force distribution device also provides a platform to attach jewelry, charms, or any other fashion accessory. Currently, there is no way to attach jewelry to the back of the neck. It might be possible to tie accessories or turn a necklace backwards, but nothing has been designed to allow accessories to attach to the back of the neck.

In embodiments, jewelry and charms can attach anywhere to the neck strap force distribution device with a clip, similar to a wearer's brooch. They can also be attached to the lower loop, with a ring similar to a keychain. They could be clipped looped through the lower loop. With sturdier materials they could even be fastened directly to the neck strap force distribution device.

In embodiments, the neck strap force distribution device is a viable solution in several different areas of the fashion industry including bustier (C-cup or larger bra size) women, working out, aerobics, cardio, running, dancing, hiking, water sports, weightlifting, movement activities, and the like. In embodiments, the device may be integrated with or into clothing and other objects that conventionally are tied with a neck strap around a user's neck. In embodiments, an integrated device may be configured to be adjustably fixed to one of the straps with at least one entry and one exit hole (e.g., hole 102 and 106 depicted herein) for the other strap. In embodiments, the device may be configured as a component of a product and offered for sale with the product, and the like.

In embodiments, the neck strap force distribution device can be manufactured from various materials, in several shapes, sizes, and configurations. The material mix may include without limitation: soft pliable material, such as rubber, silicone, vinyl, neoprene, fabric (e.g., flax, wool, fabric blends, and the like), and the like. The material mix may include, without limitation, stiff and/or composite materials that may optionally include a pliable, conforming backing, and may be made at least in part of metal, wood, resin, epoxy, and the like.

In embodiments, the material for manufacture will depend on the usage of the neck strap force distribution device. Stiffer materials are more effective for attaching jewelry and fashion accessories. Softer materials are more suitable for activities which require lots of movement.

In embodiments, the neck strap force distribution device can be produced in a number of variations. A 2-hole design made from a stiff material may be better suited for active wear, when a knot is still desired. The 3-hole design with a softer material is better suited for swim wear and a knot would be uncomfortable. A 4-hole design will be most appropriate for displaying jewelry or when one device is used for the upper strings and lower strings of in the straps, such as of a.

While the disclosure has been disclosed in connection with the preferred embodiments shown and described in detail, various modifications and improvements thereon will become readily apparent to those skilled in the art. Accordingly, the spirit and scope of the present disclosure is not to be limited by the foregoing examples, but is to be understood in the broadest sense allowable by law.

What is claimed is:

1. A fashion accessory anchor device comprising:

a plurality of garment strap receiving holes disposed along a horizontal axis of the device;

an engagement surface in communication with the plurality of receiving holes, the engagement surface for disposing the device on a nape of a user and through which a set of garment straps are received; and a fashion accessory retention region disposed vertically offset from the plurality of receiving holes along a vertical axis of the device and constructed to support a hanging fashion accessory independently of the set of garment straps.

2. The device of claim 1, wherein the fashion accessory retention region includes one or more exit holes for delivery of one or more garment straps of the set of garment straps to the engagement surface.

3. The device of claim 2, wherein the delivery of the one or more garment straps of the set of garment straps is adapted to support the fashion accessory.

4. The device of claim 1, wherein the fashion accessory retention region further includes a fashion accessory attachment mechanism.

5. The device of claim 1, wherein the engagement surface comprises a pliable layer that facilitates retention of the device to the nape of the user.

6. The device of claim 1, wherein the fashion retention region is disposed so that a fashion accessory is supported along a surface of the device opposite the engagement surface.

7. The device of claim 1, wherein the fashion retention region is disposed so that a fashion accessory is supported below the device and proximal to the nape of the user.

8. The device of claim 1, wherein the plurality of garment strap receiving holes facilitate delivery of the set of garment straps from the engagement surface to a resistance surface that is substantially opposite the engagement surface.

9. The device of claim 1, wherein one or more of the plurality of receiving holes is disposed in the fashion accessory retention region and constructed to support retention of the fashion accessory.

10. The device of claim 1, further comprising a substantially uniform thickness and wherein the engagement surface is concave and a second surface substantially opposite the engagement surface is responsively convex.

11. A method of operating a fashion accessory anchor device, the method comprising:

disposing the device proximal to a nape of the user so that a set of garment strap receiving holes are disposed substantially horizontally;

receiving a set of garment straps through a portion of the set of garment strap receiving holes for support of a garment worn by a user; and attaching a fashion accessory to a fashion accessory retention region of the device, the fashion accessory retention region disposed vertically offset from the set of garment strap receiving holes so the attached fashion accessory hangs independently of the set of garment straps, freely below the device, and proximal to the back of the user.

12. The method of claim 11 further including delivering of one or more of the set of garment straps through a garment strap exit hole disposed in the fashion accessory retention region.

13. The method of claim 12, wherein the delivering causes the attaching of the fashion accessory.

14. The method of claim 11, wherein attaching the fashion accessory includes attaching the fashion accessory to a fashion accessory attachment mechanism disposed proximal to the fashion accessory retention region.

15. The method of claim 11, wherein disposing the device includes orienting an engagement surface that comprises a pliable layer toward the nape of the user.

16. The method of claim 15, wherein the fashion retention region includes a surface of the device opposite the engagement surface.

17. The method of claim 15, wherein the fashion retention region is disposed so that a first portion of the fashion accessory overlaps a portion of the fashion retention region and a second portion of the fashion accessory is disposed below the device and proximal to the back of the user.

18. A method of accessorizing using a fashion anchor device, the method comprising:

receiving a pair of garment straps of a garment;

retaining the pair of garment straps proximal to a nape of a wearer of the garment while distributing a force exerted by the pair of garment straps across a contact region of the device on the nape of the wearer; and providing a fashion accessory retention region for retaining a fashion accessory attached thereto independently of the pair of garment straps.

19. The method of claim 18, wherein the fashion retention region is disposed so that a portion of the fashion accessory is retained along a surface of the device.

20. The method of claim 18, wherein the fashion retention region is disposed so that the fashion accessory is retained below the device and proximal to the back of the user.

* * * * *